US005734364A

United States Patent [19]

Hirai et al.

[11] Patent Number: 5,734,364

[45] Date of Patent: Mar. 31, 1998

[54] METHOD OF DRIVING A PICTURE DISPLAY DEVICE

[75] Inventors: Yoshinori Hirai; Akira Nakazawa; Makoto Nagai; Takeshi Kuwata, all of Yokohama, Japan

[73] Assignee: Asahi Glass Company Ltd., Tokyo, Japan

[21] Appl. No.: 545,766

[22] PCT Filed: Apr. 7, 1995

[86] PCT No.: PCT/JP95/00693

§ 371 Date: Nov. 24, 1995

§ 102(e) Date: Nov. 24, 1995

[87] PCT Pub. No.: WO95/27972

PCT Pub. Date: Oct. 19, 1995

[30] Foreign Application Priority Data

| | | | |
|---|---|---|---|
| Apr. 8, 1994 | [JP] | Japan | 6-71095 |
| Jun. 13, 1994 | [JP] | Japan | 6-130640 |
| Jun. 13, 1994 | [JP] | Japan | 6-130641 |

[51] Int. Cl.[6] ..... G09G 3/36

[52] U.S. Cl. ..... 345/95; 345/96; 345/100

[58] Field of Search ..... 345/58, 87, 94, 345/95, 96, 98–100

[56] References Cited

U.S. PATENT DOCUMENTS 5,262,881 11/1993 Kuwata et al. .

5,485,173 1/1996 Scheffer et al. ..... 345/87

FOREIGN PATENT DOCUMENTS 0522510 1/1993 European Pat. Off. .

0581255 2/1994 European Pat. Off. .

*Primary Examiner*—Steven Saras

*Attorney, Agent, or Firm*—Oblon, Spivak, McClelland, Maier & Neustadt, P.C.

[57] ABSTRACT

A method of driving a picture display device having a plurality (an M number) of row electrodes and a plurality of column electrodes, by selecting an L number ($L \geqq 3$) of row electrodes simultaneously and by applying to the row electrodes voltages based on signals obtained by developing in time sequence column vectors of an M row–N column orthogonal matrix S (having elements 1, −1 and 0), wherein column electrode display pattern vectors ($x = x_1, x_2, \ldots X_M$) which have as elements display patterns (1: OFF, −1: ON), corresponding to simultaneously selected row electrodes, on a specified column electrode, and column electrode voltage sequence vectors ($y) = (y_1, y_2, \ldots y_N$) which have as elements voltage levels, on the column electrode which consists of an N number of voltage pulses arranged in time sequence in a display cycle, have a relation of ($y_1, y_2, \ldots y_N) = (x_1, x_2, \ldots x_M$) (S), wherein when $\Delta y_1 = |y_1 - y_{i-1}|$ (i=2–N), the sum Q of the maximum value $\Delta y_{MAX1}$ of $\Delta y_1$ to (x)=(1, 1, . . . 1) and the maximum value $\Delta y_{MAX2}$ of $\Delta y_1$ to (1, −1, 1, −1, . . . ) substantially satisfies $Q < 1.4 \times L$.

21 Claims, 22 Drawing Sheets

$$(A) = \begin{pmatrix} -1 & 1 & 1 & 1 \\ 1 & -1 & 1 & 1 \\ 1 & 1 & -1 & 1 \\ 1 & 1 & 1 & -1 \end{pmatrix}$$

$$(y) = (2 \quad 2 \quad 2 \quad 2) \quad \text{Maximum displacement} = 0$$

(a)

(b)

(c)

(d)

FIGURE 4 (a)
Example of
4 x 4 Hadamard's matrix
(A)
| | | | | |
|---|---|---|---|---|
| L = 1 | 1 | 1 | 1 | 1 |
| L = 2 | 1 | -1 | 1 | -1 |
| L = 3 | 1 | 1 | -1 | -1 |
| L = 4 | 1 | -1 | -1 | 1 |
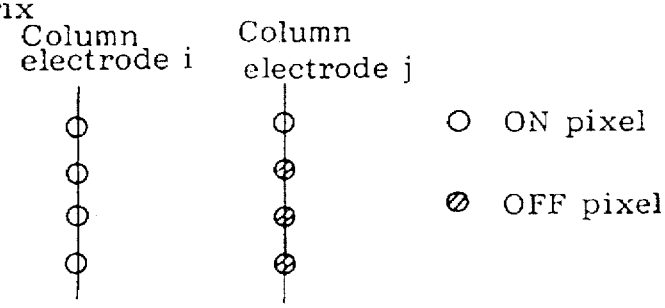
FIGURE 4 (b)
Column electrode i
(d) (-1 -1 -1 -1)
(v) (-4 0 0 0)
Column electrode j
(d) (-1 1 1 1)
(v) ( 2 -2 -2 -2)
FIGURE 4 (c)
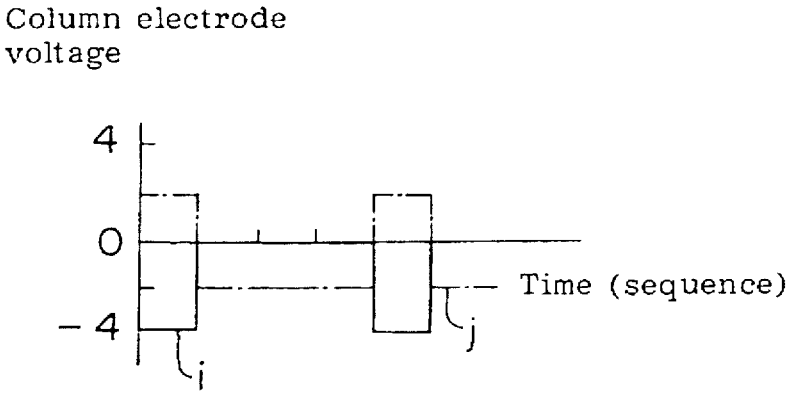

FIGURE 5 (a)

$$(A) = \begin{pmatrix} 1 & 1 & 1 & 1 \\ 1 & -1 & 1 & -1 \\ 1 & 1 & -1 & -1 \\ 1 & -1 & -1 & 1 \end{pmatrix}$$

$$(y) = \begin{pmatrix} 4 & 0 & 0 & 0 \end{pmatrix}$$ Maximum displacement = 4

FIGURE 5 (b)

$$(A) = \begin{pmatrix} 1 & 1 & 1 & 1 & 1 & 1 & 1 & 1 \\ 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}$$

$$(y) = \begin{pmatrix} 8 & 0 & 0 & 0 & 0 & 0 & 0 & 0 \end{pmatrix}$$ Maximum displacement = 8

FIGURE 5 (c)

$$(A) = \begin{pmatrix} 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}$$

$$(y) = \begin{pmatrix} 7 & -1 & -1 & -1 & -1 & -1 & -1 & -1 \end{pmatrix}$$ Maximum displacement = 8

FIGURE 6

$$(A) = \begin{pmatrix}
1 & 1 & 1 & 1 & 1 & 1 & 1 & 1 & 1 & 1 & 1 & 1 & 1 & 1 & 1 & 1 \\
1 & -1 & 1 & -1 & 1 & -1 & 1 & -1 & 1 & -1 & 1 & -1 & 1 & -1 & 1 & -1 \\
1 & 1 & -1 & -1 & 1 & 1 & -1 & -1 & 1 & 1 & -1 & -1 & 1 & 1 & -1 & -1 \\
1 & -1 & -1 & 1 & 1 & -1 & -1 & 1 & 1 & -1 & -1 & 1 & 1 & -1 & -1 & 1 \\
1 & 1 & 1 & 1 & -1 & -1 & -1 & -1 & 1 & 1 & 1 & 1 & -1 & -1 & -1 & -1 \\
1 & -1 & 1 & -1 & -1 & 1 & -1 & 1 & 1 & -1 & 1 & -1 & -1 & 1 & -1 & 1 \\
1 & 1 & -1 & -1 & -1 & -1 & 1 & 1 & 1 & 1 & -1 & -1 & -1 & -1 & 1 & 1 \\
1 & -1 & -1 & 1 & -1 & 1 & 1 & -1 & 1 & -1 & -1 & 1 & -1 & 1 & 1 & -1 \\
1 & 1 & 1 & 1 & 1 & 1 & 1 & 1 & -1 & -1 & -1 & -1 & -1 & -1 & -1 & -1 \\
1 & -1 & 1 & -1 & 1 & -1 & 1 & -1 & -1 & 1 & -1 & 1 & -1 & 1 & -1 & 1 \\
1 & 1 & -1 & -1 & 1 & 1 & -1 & -1 & -1 & -1 & 1 & 1 & -1 & -1 & 1 & 1 \\
1 & -1 & -1 & 1 & 1 & -1 & -1 & 1 & -1 & 1 & 1 & -1 & -1 & 1 & 1 & -1 \\
1 & 1 & 1 & 1 & -1 & -1 & -1 & -1 & -1 & -1 & -1 & -1 & 1 & 1 & 1 & 1 \\
1 & -1 & 1 & -1 & -1 & 1 & -1 & 1 & -1 & 1 & -1 & 1 & 1 & -1 & 1 & -1 \\
1 & 1 & -1 & -1 & -1 & -1 & 1 & 1 & -1 & -1 & 1 & 1 & 1 & 1 & -1 & -1 \\
1 & -1 & -1 & 1 & -1 & 1 & 1 & -1 & -1 & 1 & 1 & -1 & 1 & -1 & -1 & 1
\end{pmatrix}$$

$$(y) = (16\ 0\ 0\ 0\ 0\ 0\ 0\ 0\ 0\ 0\ 0\ 0\ 0\ 0\ 0\ 0)$$

Maximum displacement = 16

FIGURE 7

$$(A) = \begin{pmatrix}
-1 & 1 & 1 & -1 & -1 & -1 & 1 & 1 \\
1 & 1 & 1 & 1 & -1 & -1 & -1 & -1 \\
1 & -1 & -1 & 1 & -1 & -1 & 1 & 1 \\
1 & 1 & -1 & -1 & 1 & -1 & 1 & -1 \\
1 & -1 & 1 & -1 & 1 & -1 & -1 & 1 \\
1 & 1 & -1 & -1 & -1 & 1 & -1 & 1 \\
1 & -1 & 1 & -1 & -1 & 1 & 1 & -1
\end{pmatrix}$$

$$(y) = (5\ \ 1\ \ 1\ \ -3\ \ -3\ \ -3\ \ 1\ \ 1$$

Maximum displacement = 4

FIGURE 8 (a)

$$(A) = \begin{pmatrix} -1 & 1 & 1 & 1 \\ 1 & -1 & 1 & 1 \\ 1 & 1 & -1 & 1 \\ 1 & 1 & 1 & -1 \end{pmatrix}$$

$$(y) = (2 \quad 2 \quad 2 \quad 2) \quad \text{Maximum displacement} = 0$$

FIGURE 8 (b)

$$(A) = \begin{pmatrix} -1 & 1 & 1 & 1 & -1 & 1 & 1 & 1 \\ 1 & -1 & 1 & 1 & 1 & -1 & 1 & 1 \\ 1 & 1 & -1 & 1 & 1 & 1 & -1 & 1 \\ 1 & 1 & 1 & -1 & 1 & 1 & 1 & -1 \\ -1 & 1 & 1 & 1 & 1 & -1 & -1 & -1 \\ 1 & -1 & 1 & 1 & -1 & 1 & -1 & -1 \\ 1 & 1 & -1 & 1 & -1 & -1 & 1 & -1 \\ 1 & 1 & 1 & -1 & -1 & -1 & -1 & 1 \end{pmatrix}$$

$$(y) = (4 \quad 4 \quad 4 \quad 4 \quad 0 \quad 0 \quad 0 \quad 0) \quad \text{Maximum displacement} = 4$$

FIGURE 8 (c)

$$(A) = \begin{pmatrix} -1 & 1 & 1 & 1 & -1 & 1 & 1 & 1 & -1 & 1 & 1 & 1 & -1 & 1 & 1 & 1 \\ 1 & -1 & 1 & 1 & 1 & -1 & 1 & 1 & 1 & -1 & 1 & 1 & 1 & -1 & 1 & 1 \\ 1 & 1 & -1 & 1 & 1 & 1 & -1 & 1 & 1 & 1 & -1 & 1 & 1 & 1 & -1 & 1 \\ 1 & 1 & 1 & -1 & 1 & 1 & 1 & -1 & 1 & 1 & 1 & -1 & 1 & 1 & 1 & -1 \\ -1 & 1 & 1 & 1 & 1 & -1 & -1 & -1 & -1 & 1 & 1 & 1 & 1 & -1 & -1 & -1 \\ 1 & -1 & 1 & 1 & -1 & 1 & -1 & -1 & 1 & -1 & 1 & 1 & -1 & 1 & -1 & -1 \\ 1 & 1 & -1 & 1 & -1 & -1 & 1 & -1 & 1 & 1 & -1 & 1 & -1 & -1 & 1 & -1 \\ 1 & 1 & 1 & -1 & -1 & -1 & -1 & 1 & 1 & 1 & 1 & -1 & -1 & -1 & -1 & 1 \\ -1 & 1 & 1 & 1 & -1 & 1 & 1 & 1 & 1 & 1 & 1 & 1 & 1 & -1 & -1 & -1 \\ 1 & -1 & 1 & 1 & 1 & -1 & 1 & 1 & -1 & 1 & -1 & -1 & -1 & 1 & -1 & -1 \\ 1 & 1 & -1 & 1 & 1 & 1 & -1 & 1 & -1 & -1 & 1 & -1 & -1 & -1 & 1 & -1 \\ 1 & 1 & 1 & -1 & 1 & 1 & 1 & -1 & -1 & -1 & -1 & 1 & -1 & -1 & -1 & 1 \\ -1 & 1 & 1 & 1 & 1 & -1 & -1 & -1 & 1 & -1 & -1 & -1 & -1 & 1 & 1 & 1 \\ 1 & -1 & 1 & 1 & -1 & 1 & -1 & -1 & -1 & 1 & -1 & -1 & 1 & -1 & 1 & 1 \\ 1 & 1 & -1 & 1 & -1 & -1 & 1 & -1 & -1 & -1 & 1 & -1 & 1 & 1 & -1 & 1 \\ 1 & 1 & 1 & -1 & -1 & -1 & -1 & 1 & -1 & -1 & -1 & 1 & 1 & 1 & 1 & -1 \end{pmatrix}$$

$$(y) = (8 \quad 8 \quad 8 \quad 8 \quad 0 \quad 0 \quad 0 \quad 0 \quad 0 \quad 0 \quad 0 \quad 0 \quad 0 \quad 0 \quad 0 \quad 0)$$

Maximum displacement = 8

FIGURE 9

$$(A) = \begin{pmatrix} -1 & -1 & -1 & -1 & -1 & 1 & -1 & -1 \\ 1 & -1 & 1 & -1 & -1 & -1 & 1 & -1 \\ -1 & 1 & -1 & -1 & -1 & -1 & 1 & 1 \\ 1 & -1 & -1 & -1 & 1 & -1 & -1 & 1 \\ -1 & 1 & 1 & -1 & 1 & -1 & -1 & -1 \\ -1 & -1 & 1 & 1 & -1 & -1 & -1 & 1 \\ 1 & 1 & -1 & 1 & -1 & -1 & -1 & -1 \end{pmatrix}$$

$$(y) = (-1 \quad -1 \quad -1 \quad -3 \quad -3 \quad -5 \quad -3 \quad -1)$$

Maximum displacement = 2

FIGURE 10

$$(A) = \begin{pmatrix} 1 & 1 & -1 & -1 & 1 & -1 & -1 & 1 \\ 1 & -1 & -1 & 1 & -1 & -1 & 1 & 1 \\ 1 & 1 & 1 & 1 & -1 & -1 & -1 & -1 \\ 1 & 1 & 1 & -1 & -1 & 1 & 1 & 1 \\ 1 & -1 & -1 & -1 & -1 & 1 & -1 & -1 \\ -1 & -1 & 1 & -1 & -1 & -1 & -1 & 1 \\ -1 & 1 & -1 & -1 & -1 & -1 & 1 & -1 \end{pmatrix}$$

$$(y) = (3 \quad 1 \quad -1 \quad -3 \quad -5 \quad -3 \quad -1 \quad 1)$$

Maximum displacement = 2

FIGURE 18(a)

$$(A) = \begin{pmatrix} 1 & 1 & 1 & 1 \\ 1 & -1 & 1 & -1 \\ 1 & 1 & -1 & -1 \\ 1 & -1 & -1 & 1 \end{pmatrix}$$

$(y)_1 = (4 \quad 0 \quad 0 \quad 0)$ Maximum displacement = 4

$(y)_2 = (0 \quad 4 \quad 0 \quad 0)$ Maximum displacement = 4

FIGURE 18(b)

$$(A) = \begin{pmatrix} 1 & 1 & 1 & 1 & 1 & 1 & 1 & 1 \\ 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}$$

$(y)_1 = (8 \quad 0 \quad 0 \quad 0 \quad 0 \quad 0 \quad 0 \quad 0)$ Maximum displacement = 8

$(y)_2 = (0 \quad 8 \quad 0 \quad 0 \quad 0 \quad 0 \quad 0 \quad 0)$ Maximum displacement = 8

FIGURE 18(c)

$$(A) = \begin{pmatrix} 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}$$

$(y)_1 = (7 \quad -1 \quad -1 \quad -1 \quad -1 \quad -1 \quad -1 \quad -1)$ Maximum displacement = 8

$(y)_2 = (1 \quad 7 \quad 1 \quad -1 \quad 1 \quad -1 \quad 1 \quad -1)$ Maximum displacement = 6

FIGURE 19

$$(A) = \begin{pmatrix} 1 & 1 & 1 & -1 & -1 & -1 & 1 & -1 \\ 1 & 1 & -1 & 1 & -1 & -1 & -1 & 1 \\ -1 & 1 & 1 & -1 & 1 & -1 & -1 & 1 \\ -1 & -1 & 1 & 1 & -1 & -1 & -1 & -1 \\ -1 & -1 & -1 & -1 & -1 & -1 & 1 & 1 \\ -1 & 1 & -1 & -1 & -1 & 1 & -1 & -1 \\ 1 & -1 & -1 & -1 & 1 & -1 & -1 & -1 \end{pmatrix}$$

$$(y)_1 = (-1 \quad 1 \quad -1 \quad -3 \quad -3 \quad -5 \quad -3 \quad -1)_{\text{Maximum displacement}} = 2$$

$$(y)_2 = (1 \quad 1 \quad 1 \quad 5 \quad 3 \quad 1 \quad 3 \quad -1)_{\text{Maximum displacement}} = 4.$$

FIGURE 20 (a)

$$(A) = \begin{pmatrix} -1 & -1 & 1 & -1 & 1 & -1 & -1 & 1 \\ -1 & -1 & -1 & -1 & -1 & 1 & -1 & -1 \\ -1 & 1 & -1 & -1 & -1 & -1 & 1 & 1 \\ 1 & -1 & -1 & 1 & -1 & -1 & -1 & 1 \\ 1 & -1 & 1 & -1 & -1 & -1 & 1 & -1 \\ -1 & 1 & 1 & 1 & -1 & -1 & -1 & -1 \\ 1 & 1 & -1 & -1 & 1 & -1 & -1 & -1 \end{pmatrix}$$

$$(y)_1 = (-1 \quad -1 \quad -1 \quad -3 \quad -3 \quad -5 \quad -3 \quad -1)_{\text{Maximum displacement}} = 2$$

$$(y)_2 = (1 \quad -1 \quad 1 \quad 5 \quad 3 \quad 3 \quad 3 \quad -1)_{\text{Maximum displacement}} = 4$$

FIGURE 20 (b)

$$(A) = \begin{pmatrix} -1 & 1 & -1 & -1 & -1 & 1 & -1 & -1 \\ 1 & -1 & -1 & -1 & 1 & -1 & -1 & -1 \\ -1 & -1 & -1 & -1 & -1 & -1 & 1 & 1 \\ 1 & 1 & 1 & -1 & -1 & -1 & 1 & -1 \\ -1 & -1 & 1 & 1 & -1 & -1 & -1 & -1 \\ -1 & 1 & 1 & -1 & 1 & -1 & -1 & 1 \\ 1 & 1 & -1 & 1 & -1 & -1 & -1 & 1 \end{pmatrix}$$

$$(y)_1 = (-1 \quad 1 \quad -1 \quad -3 \quad -3 \quad -5 \quad -3 \quad -1)_{\text{Maximum displacement}} = 2$$

$$(y)_2 = (-3 \quad 1 \quad -3 \quad -3 \quad -5 \quad -1 \quad -1 \quad -1)_{\text{Maximum displacement}} = 6$$

FIGURE 21

$$(A) = \begin{pmatrix} 1 & -1 & 1 & -1 & -1 & -1 & 1 & -1 \\ -1 & 1 & -1 & -1 & -1 & -1 & 1 & 1 \\ 1 & 1 & -1 & -1 & 1 & -1 & -1 & -1 \\ -1 & -1 & 1 & -1 & 1 & -1 & -1 & 1 \\ -1 & 1 & 1 & 1 & -1 & -1 & -1 & -1 \\ 1 & -1 & -1 & 1 & -1 & -1 & -1 & 1 \\ -1 & -1 & -1 & -1 & -1 & 1 & -1 & -1 \end{pmatrix}$$

$$(y)_1 = (-1 \quad -1 \quad -1 \quad -3 \quad -3 \quad -5 \quad -3 \quad -1)_{\text{Maximum displacement}} = 2$$

$$(y)_2 = (1 \quad -1 \quad 1 \quad 1 \quad -1 \quad -1 \quad -1 \quad 7)_{\text{Maximum displacement}} = 8$$

FIGURE 25 (a)
$$\begin{pmatrix} 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}$$
FIGURE 25 (b)
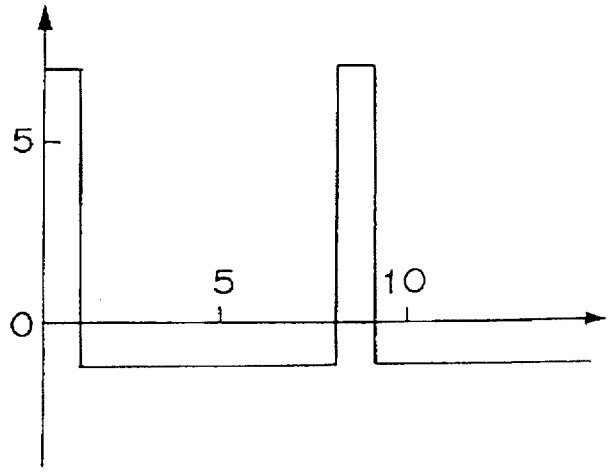
FIGURE 25 (c)
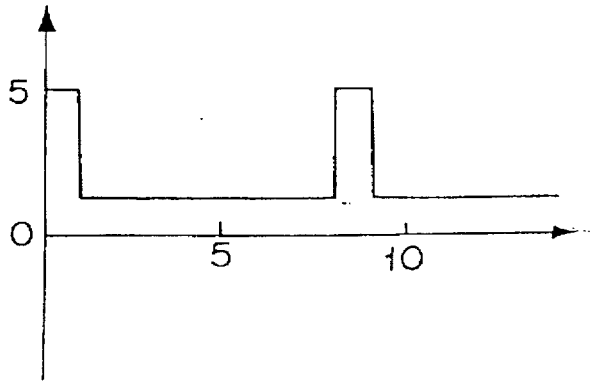

FIGURE 26 (a)
$$\begin{pmatrix} -1 & 1 & 1 & -1 & -1 & -1 & 1 & 1 \\ 1 & 1 & 1 & 1 & -1 & -1 & -1 & -1 \\ 1 & -1 & -1 & 1 & -1 & -1 & 1 & 1 \\ 1 & 1 & -1 & -1 & 1 & -1 & 1 & -1 \\ 1 & -1 & 1 & -1 & 1 & -1 & -1 & 1 \\ 1 & 1 & -1 & -1 & -1 & 1 & -1 & 1 \\ 1 & -1 & 1 & -1 & -1 & 1 & 1 & -1 \end{pmatrix}$$
FIGURE 26 (b)
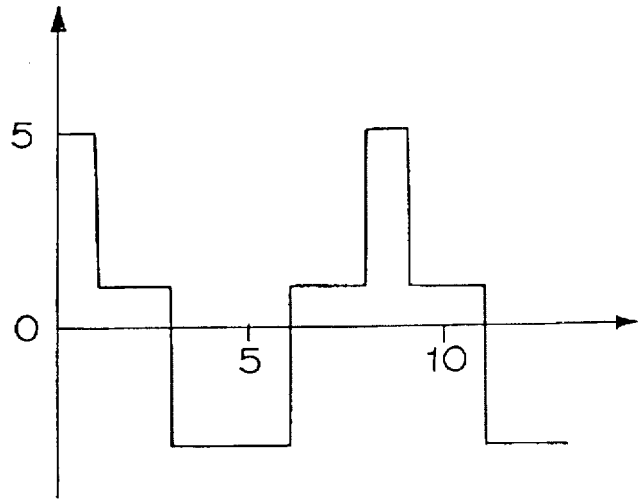
FIGURE 26 (c)
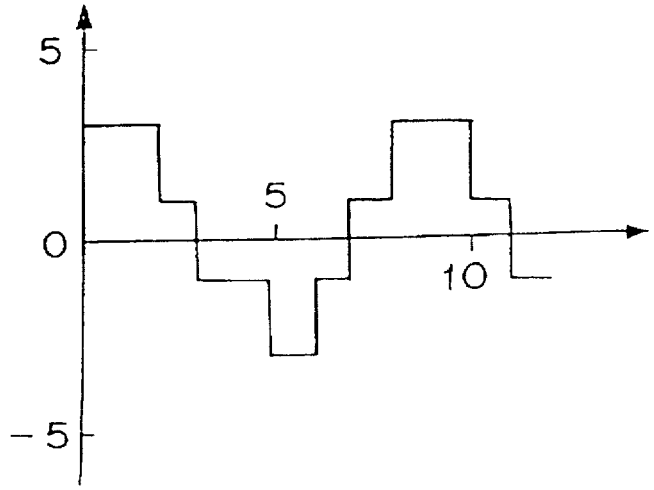

METHOD OF DRIVING A PICTURE DISPLAY DEVICE

TECHNICAL FIELD

The present invention relates to a method of driving a liquid crystal display device suitable for a liquid crystal of high speed response.

Particularly, the present invention relates to a method of reducing a crosstalk in a method of driving a passive matrix type liquid crystal display device wherein multiplex driving is conducted by a multiple line selection method (a MLS method, reference to U.S. Pat No. 5,262,881).

BACKGROUND ART (Control of frame response in conventional techniques)

In this specification, a scanning electrode is referred to as a row electrode and a data electrode is referred to as a column electrode.

In a highly intelligence-oriented age, demands to media for information display are increasing. Liquid crystal displays have advantages of thin, light in weight and a low power consumption as well as good adaptability to semiconductor technology; hence, they will be increasingly used. With the propagation of use, there are demands to a large picture surface and a highly precise picture. And a display of large capacity is seeked. In several techniques, a STN (super-twisted nematic) method is simpler in manufacturing process and lower in cost than a TFT (thin film transistor) method, and accordingly, it is likely that the STN methods become the main stream for future liquid crystal displays.

In order to obtain a large capacity display with use of the STN method, a successive line multiplexed driving (a-line-at-a time scanning) method has been used. In this method, row electrodes are successively selected one by one while column electrodes are driven in corresponding to a pattern to be displayed. When all the row electrodes are selected, the display of one picture is finished.

In the successive line driving method, however, there is known a problem called a frame response which is caused when the capacity of display is large. In the successive line driving method, pixels are applied with relatively high voltages at the time of selection and relatively low voltages at the time of non-selection. The voltage ratio generally becomes large as the number of row electrodes is large (a high duty driving). Accordingly, liquid crystal which has been responsible to the effective value of voltages (RMS voltage: root mean square voltage) when the voltage ratio is small, becomes responsive to the waveform of the voltages to be applied. Namely, the frame response is a phenomenon caused when the transmittance at the OFF time is increased due to a large amplitude of selection pulses and the transmittance at the ON time is decreased due to a long time interval of the selection pulses, as a result of which the contrast ratio is decreased.

In order to suppress the occurrence of the frame response, there has been known a method of increasing a frame frequency to thereby shorten the time interval of the selection pulses. However, such method has a serious problem. Namely, when the frame frequency is increased, the frequency spectrum of the waveform of applied voltage becomes high. Accordingly, the high-frequency driving method causes an unevenness of display, that is a lack of display uniformity and increase the power consumption. Thus, there is an upper limit in determination of the frame frequency in order to avoid the formation of selection pulses having a narrow width.

Recently, a new driving method has been proposed to overcome the problem without increasing the frequency spectrum. In U.S. Pat No. 5,262,881, for instance, a multiple line selection method (MLS method) is described wherein a plurality of row electrodes (selection electrodes) are simultaneously selected. In this method, a plurality of row electrodes are simultaneously selected, and a display pattern in the direction of columns can be controlled independently, whereby the time interval of selection pulse can be shortened while the width of selection pulses can be kept in constant. Namely, a display of high contrast can be obtained while the frame response is controlled.

Further, as another technique of controlling the frame response, there is a method disclosed in European Patent Publication No. 507061. In this method, all electrodes are selected at a time to control the frame response.

<Summary of a driving method of simultaneously selecting a plurality of row electrodes>

In the multiple line selection method disclosed in U.S. Pat. No. 5,262,881, a series of specified voltage pulses are applied to each of the row electrodes which have been simultaneously selected whereby a column display pattern can be independently controlled. In the driving method of simultaneously selecting a plurality of lines, since voltage pulses are simultaneously applied to a plurality of the row electrodes. Accordingly, it is necessary to apply pulse voltages having different polarities to the row electrodes in order to independently and simultaneously control the display pattern of the direction of column. The voltage pulses having different polarities are applied several times to the row electrodes with the result that the effective value of voltages (RMS voltages) corresponding to ON or OFF are applied to each pixel in the whole.

A group of selection pulse voltages applied to the simultaneously selected row electrodes within an addressing time can be expressed by a matrix of L rows and K columns (hereinafter, referred to as a selection matrix (A)). Since a sequence of the selection pulse voltages corresponding to each of the row electrodes can be expressed as a group of vectors which are orthogonal in the addressing period, the matrix including these as row elements is an orthogonal matrix. Namely, row vectors in the matrix are orthogonal in mutual. In this case, the number of row electrodes corresponds to the number simultaneously selected, and each row corresponds to each line. For instance, the first line in an L number of simultaneously selected lines corresponds to elements in the first row in the selection matrix (A). Then, selection pulses are applied to the elements in the first column, the elements in the second column in this order. In the selection matrix (A), a numerical value 1 indicates a positive selection pulse and a numerical value −1 indicates a negative selection pulse.

Voltage levels corresponding to column elements in the matrix and a column display pattern are applied to the column electrodes. Namely, a series of column electrode voltages is determined by the display pattern and the matrix by which a series of row electrode voltages is determined.

The sequence of voltage waveforms applied to column electrodes is determined as follows.

FIG. 4 is a diagram showing column voltages applied. An example of an Hadamard's matrix of 4 rows and 4 columns as the selection matrix will be described. Supposing that display data on column electrodes i and j are as shown in FIG. 4, a column display pattern can be shown as a vector d in FIG. 4*b*. In this case, a numerical value −1 indicates an ON display on a column element and a numerical value 1 indicates an OFF display. When row electrode voltages are successively applied to row electrodes in the order of the columns in the matrix, the column electrode voltage levels assumes vectors v as shown in FIG. 4*b*, and the waveform of the voltages is as in FIG. 4*c*. In FIG. 4*c*, the ordinate and the abscissa respectively have an arbitrary unit.

In a case of the selection of a part of selection lines, it is preferable to dispersively apply the selection pulse voltages in a display cycle in order to control the frame response of the liquid crystal display element. For instance, the first element of the vector v is first applied to a first group of row electrodes which are simultaneously selected (hereinbelow, referred to as a subgroup). Then, the first element of the vector v is applied to a second group of row electrodes which are simultaneously selected. The same sequence is taken successively.

The sequence of voltage pulses applied to the column electrodes is determined depending on how the voltage pulses are dispersed in a display cycle or which selection matrix (A) is selected for the group of row electrodes which are simultaneously selected.

Although the multiple line selection method is very effective to drive a fast responding liquid crystal display element with a high contrast ratio, there has been revealed that an undesirable non-uniformity of a display such as a crosstalk sometimes takes place.

It is an object of the present invention to reduce an undesired uneven display such as a crosstalk in a driving method for simultaneously selecting of a plurality of row electrodes.

DISCLOSURE OF INVENTION

<Summary of the invention>

The inventors of this application have studied the causes of the uneven display in the multiple line selection method. As a result, they have found that the uneven display takes place due to an inherent cause in the multiple line selection method which is different from the conventional successive line driving method. Further, we have found that a display having excellent uniformity can be obtained by practicing the present invention described hereinbelow. The degree of uniformity of a display obtained by practicing the present invention is sometimes superior to that of the conventional successive line driving method.

In this specification, a display cycle means the shortest time period in which addressing operations for all row electrodes are finished. Namely, it means the shortest time period by which an effective voltage value is determined. In other words, it can be said to be a time period in which the row vector components which are orthogonally arranged in the orthogonal matrix (S), which is described hereinafter, are applied to all the selection electrodes. In this specification, except for being specifically mentioned, L indicates the number of simultaneously selected row electrodes, K indicates the number of selection pulses applied to a specified row electrode in one display cycle, M indicates the number of the total row electrodes, and N indicates the number of pulses applied in one display cycle.

According to the present invention, there is provided a method of driving a picture display device having a plurality (an M number) of row electrodes and a plurality of column electrodes, by selecting an L number ($L \geqq 3$) of row electrodes simultaneously and by applying to the row electrodes voltages based on signals obtained by developing in time sequence column vectors of an M row–N column orthogonal matrix S (having elements 1, −1 and 0), the driving method being characterized in that:

column electrode display pattern vectors ($x=x_1, x_2, \ldots x_M$) which have as elements display patterns (1: OFF, −1: ON), corresponding to simultaneously selected row electrodes, on a specified column electrode, and column electrode voltage sequence vectors ($y=(y_1, y_2, \ldots y_N)$) which have as elements voltage levels, on the column electrode which consists of an N number of voltage pulses arranged in time sequence in a display cycle, have a relation of $(y_1, y_2, \ldots y_N)=(x_1, x_2 \ldots x_M)$ (S), wherein when $\Delta y_1=|y_1-y_{i-1}|(i=2-N)$, the sum Q of the maximum value $\Delta y_{MAX1}$ of $\Delta y_1$ to $(x)=(1, 1, \ldots 1)$ and the maximum value $\Delta y_{MAX2}$ of $\Delta y_1$ to $(1, -1, 1, -1, \ldots)$ substantially satisfies $Q<1.4 \cdot L$.

Further, in an aspect of the present invention, there is provided a method of driving a picture display device having a plurality (an M number) of row electrodes and a plurality of column electrodes, by selecting an L number ($L \geqq 3$) of row electrodes simultaneously and by applying to the row electrodes voltages based on signals obtained by developing in time sequence column vectors of an M row –N column orthogonal matrix S (having elements 1, −1 and 0). The driving method being characterized in that:

the polarities of row signals and column signals are inverted before the completion of a display cycle;

column electrode display pattern vectors ($x=(x_1, x_2, \ldots x_M)$) which have as elements display patterns (1: OFF, −1: ON), corresponding to simultaneously selected row electrodes, on a specified column electrode, and column electrode voltage sequence vectors ($y=(y_1, y_2, \ldots y_N)$) which have as elements voltage levels, on the column electrode which consists of an N number of voltage pluses arranged in time sequence in the display cycle, have a relation of $(y_1, y_2, \ldots y_N)=(x_1, x_2, \ldots x_M)$ (S), and when an L number of row electrodes are simultaneously selected, column electrode voltages $y_{j-1}$ and $y_j$, before and after the polarity inversion, to $(x)=(1, 1, \ldots 1)$ and $(x)=(1, -1, 1, -1 \ldots)$ respectively assume $|y_{j-1}| \leqq 0.5 \cdot L$ and $|y_j| \leqq 0.5 \cdot L$ (j−1 and j are affix letters indicating before and after the polarity inversion).

Further, in an aspect of the present invention, there is provided a method of driving a picture display device having a plurality (an M number) of row electrodes and a plurality of column electrodes, by selecting an L number ($L \geqq 5$) of row electrodes simultaneously and by applying to the row electrodes voltages based on signals obtained by developing in time sequence column vectors of an M row –N column orthogonal matrix S (having elements 1, −1 and 0), the driving method being characterized in that:

column electrode display pattern vectors ($x=x_1, x_2, \ldots x_M$) which have as elements display patterns (1: OFF, −1: ON), corresponding to simultaneously selected row electrodes, on a specified column electrode, and column electrode voltage sequence vectors ($y=(y_1, y_2, \ldots y_N)$) which have as elements voltage levels, on the column electrode which consists of an N number of voltage pulses arranged in time sequence in a display cycle, have a relation of $(y_1, y_2, \ldots y_N)=(x_1, x_2, \ldots x_M)$ (S), wherein when $\Delta y_1=|y_1-y_{i-1}|(i=2-N)$, $\Delta Y_1<0.7 \cdot L$ to $(x)=(1, 1, \ldots, 1)$.

Further, in an aspect of the present invention, there is provided a method of driving a picture display device having a plurality (an M number) of row electrodes and a plurality of column electrodes, by selecting an L number ($L \geqq 3$) of row electrodes simultaneously and by applying to the row electrodes voltages based on signals obtained by developing in time sequence column vectors of an M row –N column orthogonal matrix S (having elements 1, –1 and 0), the driving method being characterized in that:

the polarities of row signals and column signals are inverted before the completion of a display cycle;

column electrode display pattern vectors $(x)=(x_1, x_2, \ldots x_M)$ which have as elements display patterns (1: OFF, –1: ON), corresponding to simultaneously selected row electrodes, on a specified column electrode, and column electrode voltage sequence vectors $(y)=(y_1, y_2, \ldots y_N)$ which have as elements voltage levels, on the column electrode which consists of an N number of voltage pulses arranged in time sequence in a display cycle, have a relation of $(y_1, y_2, y_n)=(x_1, x_2, \ldots x_M)$ (S), and when an L number of row electrodes are simultaneously selected, column electrode voltages $y_{j-1}$ and $Y_j$, before and after the polarity inversion, to $(X)=(1, 1, \ldots, 1)$ respectively assume $|y_{j-1}| \leqq 0.5 \cdot L$ and $|y_j| \leqq 0.5 \cdot L$ (j–1 and j are affix letters indicating before and after the polarity inversion).

Further, according to the present invention, there is provided a method of driving a liquid crystal display device by selecting four row electrodes simultaneously, the method being characterized in that a series of pulses to be applied to simultaneously selected each row electrode has two kinds of voltage pulse polarities and the selection matrix being expressed by:

$$\begin{bmatrix} -1 & 1 & 1 & 1 \\ 1 & -1 & 1 & 1 \\ 1 & 1 & -1 & 1 \\ 1 & 1 & 1 & -1 \end{bmatrix}$$

wherein one of the voltage pulse polarities is 1 and the other is –1.

<Analysis of the cause of a crosstalk in the driving method for simultaneously selecting a plurality of row electrodes>

The inventors have studied to find that in the driving of a picture display device with use of the multiple line selection method, the crosstalk becomes conspicuous in particularly a window pattern and a half tone display. Hereinbelow, description will be made as to a crosstalk phenomenon in the window pattern.

FIG. 3 shows a case that a bar is display on a picture surface in which the influence of the crosstalk is conspicuous. In FIG. 3, a bar of W×H is displayed in the background (a region of A) wherein the background is in an entirely ON state and the bar is in a OFF state. An uneven display appears at the region of B at the lower portion of the bar. Namely, the uneven display portion is caused due to the difference of brightness of region A <region B regardless of the background being in the ON state. The difference of brightness indicates that the effective voltages applied to liquid crystal are in a relation of the region A<the region B. A display pattern such as a window display is in a combination of bars shown in FIG. 3, and will be used more frequently. Accordingly, it is a big problem to reduce the uneven display (crosstalk).

The magnitude of the crosstalk varies depending on a change of the width W or the length of L of the bar. When the width W of the bar in a display pattern is made large, the difference of brightness between the region A and the region B is reduced. On the other hand, when the length L of the bar is made large, the difference of brightness between the region A and the region B is increased.

The above-mentioned phenomenon can be explained from the fact that the distortion of the waveform of the column electrode voltage is different between the wave form at the time of ON and the waveform at the time of OFF. Namely, the waveform at the time of ON assume a distorted form, whereas the waveform at the time of OFF assumes a substantially ideal waveform.

There are two causes in the distortion of the waveform at ON. One is that the driving system is not constituted by an ideal power source and an ideal driver. Since the major portion of the display shown in FIG. 3 is in an ON state, the major portion of the column electrodes outputs the ON waveform. At the moment, the driving system suffers a large load because the column electrodes are in the voltage level outputting the ON waveform. Accordingly, there causes the distortion of the ON waveform. The other is by the influence of the capacitance of elements in the panel. Namely, liquid crystal used for the liquid crystal display element usually has a positive electric anisotropy $\Delta\epsilon$, and accordingly, the capacitance of the liquid crystal connected in series to the column electrodes becomes the maximum at the time of an entirely ON display. Accordingly, when there are many ON waveforms, the voltage waveform in the panel takes the most distorted shape.

On the other hand, the OFF waveform is outputted with a substantially ideal shape because the capacity of the liquid crystal is too small to cause the distortion of the waveform in comparison with the ON waveform.

In FIG. 3, only the ON waveform of column electrode voltage is applied to the region A, while both the ON and OFF waveforms of column electrode voltage are applied to the region B. Accordingly, the column voltage waveform in the region A has a very distorted shape, while the degree of distortion of the column voltage waveform in the region B is not so large in comparison with the region A. Therefore, the reduction of the effective voltage applied to the liquid crystal in the region B is smaller than the region A. Thus, there is a difference of effective voltage between the region A and the region B.

Further, there is a unique crosstalk in the half tone display, different from the window pattern.

As a method of obtaining the half tone display, there are a frame rate control method, an amplitude modulation method and so on. However, the frame rate control method is widely used as the method of driving liquid crystal display devices.

The frame rate control method is frequently used in combination with a spatial modulation method in order to suppress the occurrence of a flicker. The method is to cancel the flicker by providing a difference of phase in terms of space (i.e. between adjacent pixels). In this case, however, the frequency in terms of space of a picture becomes very high for each frame, unlike a case of plane display. The high spatial frequency invites a distortion in the waveform to thereby cause the crosstalk, and the quality of picture is deteriorated. Further, use of a dithering method as a kind of the spatial modulation method also increases the spatial frequency, whereby there causes the problem of crosstalk.

Further, when a dynamic picture such as a video display is displayed in the window, there cause not only the deterioration of the quality of the dynamic picture display but also the deterioration of picture at a peripheral portion due to the crosstalk. Such deterioration is caused even in a case of displaying a dynamic picture in a video display. This is because there are many spatially complicated display (i.e. having a high spatial frequency) unlike a fundamentally geometric display such as a window pattern.

As described above, although the multiple line selection method is very effective to control the frame response, it has been revealed in the study by the inventors that an uneven display due to the crosstalk is often conspicuous in comparison with the conventional driving method.

We estimate that it is because the level of the row electrode voltage in the multiple line selection method is lower than that of the successive line driving method. Namely, when a plurality of row electrodes are simultaneously selected, the bias ratio of the row electrode voltage to the column electrode voltage becomes small, and influence of the column electrode voltage to the effective voltage is extremely large in comparison with the conventional driving method. As a result, the distortion of the voltage waveform of the column electrodes provides a large influence to the quality of display in comparison with the conventional method.

Actually, since the performances of the power source and the drive used in the driving system are finite, the distortion of the voltage waveform at their input terminals is unavoidable. Further, since there is considered a serial connection of a capacity component of the liquid crystal itself and an electrode resistance in the panel, the waveform of voltages outputted to the column electrodes is fairly dulled. Accordingly, when a plurality of row electrodes are simultaneously selected, an uneven display is sometimes resulted due to the crosstalk. Such phenomenon becomes remarkable when the number L of the row electrodes is 5 or more.

Further, in the multiple line selection method, the variation of the column electrode voltage pulses strongly influences the variation of the effective value of the column electrode voltage waveform. This is a feature peculiar to the multiple line selection method unlike the successive line driving method, which is derived from the fact that the multiple line selection method has many column electrode voltage levels in comparison with the successive line driving method. Namely, in the successive line driving method, a large distortion of the waveform is mainly produced at the time of the inversion of the polarities, whereas, in the multiple line selection driving method, it is produced even when the variation of the column electrode voltage pulses is large. In the multiple line selection method, it is considered that a strong crosstalk takes place depending on a kind of selection matrix because the column electrode voltages frequently vary.

<Sequence of column voltage pulses in the method of simultaneously selecting a plurality of row electrodes>

As described above, in order to reduce the crosstalk, it is very important to study the sequence of voltage pulses actually applied to the column electrodes. Now, description will be made as to the detail of the sequence of the voltage pulses actually applied to the column electrodes in the method of simultaneously selecting a plurality of row electrodes.

In a case of selecting simultaneously a part of row electrodes (partial line selection), there are three ways from the standpoint of determining a time point at which a selection pulse sequence is advanced. In the first way, the selection pulse sequence for row electrodes is advanced by one at a time point that after a subgroup has been selected and the next subgroup is to be selected, namely, it corresponds to a selection pulse sequence method (1) wherein subgroups constitute units. The second way corresponds to a method (2) wherein the selection pulse sequence is advanced at a time point that all lines have been selected (to all the subgroups). The third way corresponds to an intermediate method (3) of the methods (1) and (2).

Table 1 shows vectors indicating selection pulses for subgroups in a case of using the method (1) or the method (2), wherein $A_1$ and $A_2 \ldots A_M$ represent each column vector in the selection matrix A, and Ns represents the number of subgroups.

| | | | |
|---|---|---|---|
| | Method (1) | | |
| Subgroup | 1 | $A_1$ ↓ | $A_2$ ↓ |
| Subgroup | 2 | $A_2$ ↓ ↓ | $A_3$ ↓ |
| Subgroup | $N_s$ | $A_x$ | |
| | Method (2) | | |
| Subgroup | 1 | $A_1$ ↓ | $A_2$ ↓ |
| Subgroup | 2 | $A_1$ ↓ ↓ | $A_2$ ↓ |
| Subgroup | $N_s$ | $A_1$ | |

In the sequence of the voltages applied to the column electrodes, when the column electrode voltage levels can be expressed by the vectors (V)=(V1, V2, V3, . . . ) in the same manner as shown in FIG. 4*b*, vectors (v1, V2, V3, . . . , V2, V3, V4, ..) are applicable to the method (1) and vectors (V1, V1, ..V1, V2, V2, . . . , V2, V3, ..) are applicable to the method (2). The repeating number of time steps indicates the number of subgroups respectively.

The above-mentioned relation can be described in a general expression comprising vector and matrix as shown in formula (1):

Formula (1)

$(y)=(x)\ (S)$ where $(x)=(x_1, x_2, \ldots, x_M)$ $(y)=(y_1, y_2, \ldots, y_N)$ (x): Column electrode display pattern vectors (y): Column electrode voltage sequence vectors (S): Row electrode pulse sequence matrix Vectors (x), vectors (y) and a matrix (S) will be described. Column electrode display pattern vectors $(x)=(x_1, x_2, \ldots, x_M)$ has the same number of elements as the number M of the row electrodes and have display patterns corresponding to the row electrodes on a specified column electrode. In the description, a numeral 1 indicates an OFF state and a numeral −1 indicates an ON state. Column electrode voltages sequence vectors $(y)=(y_1, y_2, \ldots, y_N)$ have the same number of element as the number of pulses N applied in a display cycle, and have as elements voltage levels to specified column electrodes, which are arranged time-sequentially in a display cycle.

The row electrode pulse sequence matrix (S) is a matrix of M rows and N columns, wherein column vectors of row electrode selection voltage levels are arranged, as elements, time-sequentially in one display cycle. The element corresponding to a non-selection row electrode is 0. For instance, the row electrode pulse sequence matrix S in the method (1) includes column vectors $A_i$ of the selection matrix and 0 vectors $Z_e$ and is described as in formula (2).

$$(S)=\begin{bmatrix} A_1 & Z_e & Z_e & \dots & Z_e & A_2 & Z_e & \dots & Z_e & A_3 & Z_e & \dots & Z_e & \dots & A_k & Z_e & \dots & Z_e \\ Z_e & A_2 & Z_e & \dots & Z_e & Z_e & A_3 & \dots & Z_e & Z_e & A_4 & \dots & Z_e & \dots & Z_e & A_1 & \dots & Z_e \\ Z_e & Z_e & A_3 & \dots & Z_e & Z_e & Z_e & \dots & Z_e & Z_e & Z_e & \dots & Z_e & \dots & Z_e & Z_e & \dots & Z_e \\ \cdot & \cdot & \cdot & & \cdot & \cdot & \cdot & & \cdot & \cdot & \cdot & & \cdot & & \cdot & \cdot & & \cdot \\ \cdot & \cdot & \cdot & & \cdot & \cdot & \cdot & & \cdot & \cdot & \cdot & & \cdot & & \cdot & \cdot & & \cdot \\ \cdot & \cdot & \cdot & & \cdot & \cdot & \cdot & & \cdot & \cdot & \cdot & & \cdot & & \cdot & \cdot & & \cdot \\ Z_e & Z_e & Z_e & \dots & A_p & Z_e & Z_e & \dots & A_q & Z_e & Z_e & \dots & A_r & \dots & Z_e & Z_e & \dots & A_{p-1} \end{bmatrix} \quad \text{Formula (2)}$$

In the sequence of the method (2), since the frequency is too low, a flicker may occur. Accordingly, it is sometimes preferable to advance the selection pulse sequence before the selection pulses are applied at least once for each subgroup.

In the following, a case of employing the sequence of the method (1) is described as a typical example. Of course, the same idea is applicable also to the sequence of the method (2) or the method (3). When the sequence of the method (1) is used, the row electrode pulse sequence matrix (S) can be considered as the selection matrix (A) having an arrangement such as (A)... (A) except for a case of inverting the polarities and a case of shifting from the last subgroup to the first subgroup. It is because as shown in Table 1 or formula 2, voltages corresponding to $A_1, A_2, \dots, A_K$ are repeatedly applied to the selected subgroups.

Namely, when the sequence of the method (1) is used, the conditions of the present invention can be satisfied by suitably selecting the selection matrix A (of L rows and K columns). In other words, a suitable matrix can be formed by suitably rearranging the column vectors of an arbitrary matrix having the row vectors which are orthogonal each other, and using the matrix as the selection matrix. Then, a preferable waveform of the column electrodes can be formed. <Use of a new selection matrix>

In the following, description will be made in detail as to a preferred selection matrix to reduce the crosstalk.

In an embodiment of the present invention, the matrix (S) is evaluated under the condition of formula (3) as a standard of selecting the optimum column waveform from the standpoint that the width of the variation of the maximum voltages on the time axis (progress in sequence) can be reduced.

$$\Delta y_i = |y_i - y_{i-1}| \ (i = 2\sim N) \quad \text{Formula (3)}$$

Generally, it is preferable to suppress $\Delta y_i$ to be a predetermined value or less in all display patterns. However, this is practically difficult because $\Delta y_1$ is a value depending on the column electrode display pattern vectors (x). For instance, the value of $\Delta y_i$ in a display at entirely ON is fundamentally different from the value of the $\Delta y_i$ in a display having a checker pattern.

In this embodiment, (x)=(1, 1, . . . , 1) are selected as the column electrode display pattern vectors (x) which are used as standard. Usually, the crosstalk is conspicuous in a state of nearly entirely ON or entirely OFF, e.g., a pattern in which there is a block or a line on a uniformly flat pattern). If the crosstalk is suppressed in such state, the quality of display can be improved.

Generally, when a condition of $\Delta y_1 < 0.7 \cdot L$ (hereinbelow, referred to as a condition A) is provided, the difference of the variation of the maximum voltage can be suppressed to a practically applicable extent. More preferably, $\Delta y_i < 0.5 \cdot L$ (hereinbelow, referred to as a condition B).

The column electrode waveform obtained by Hadamard's function used in the conventional technique, will be examined.

FIG. 5*c* shows the Hadamard's matrix of 7 rows and 8 columns. When (x)=(1, 1, . . . , 1), then, (y)=(7, −1, −1, ..., −1) and the maximum displacement (the maximum value of $\Delta y_i$ is 8. Since L=7, the condition A is "$\Delta y_i < 4.9$". Accordingly, the condition A is not satisfied at the time of the maximum displacement. Namely, when the Hadamard's matrix is used as the selection matrix, the variation of the maximum voltage is large to thereby cause the distortion of the waveform and decrease the effective value (RMS voltage).

The waveform pattern at this moment is shown in FIG. 2. In FIG. 2, an arbitrary unit is used for the column voltage waveform in a state of an entirely ON display. FIG. 2 shows a large periodical change of voltage.

FIG. 7 is an example of the selection matrix (A) suitable for conducting the present invention. FIG. 7 shows a matrix of 7 rows and 8 columns. When (x)=(1, 1, . . . , 1), then, (y)=(5, 1, 1, −3, −3, −3, 1, 1), and the maximum displacement (the maximum value of $y_i$) is 4. On the other hand, since L is 7, the condition A is "$\Delta y_i < 4.9$". Accordingly, the matrix satisfies the condition A even at the time of the maximum displacement. The waveform pattern in this case is shown in FIG. 1*c* in which an arbitrary unit is used for the column voltage waveform in a state of an entirely ON display. It is easily understood that the variation of the maximum voltage is small in comparison with the waveform shown in FIG. 2 which shows a case of using an Hadamard's matrix as the selection matrix.

FIG. 8 shows another example of such matrix. FIG. 8*a* shows a matrix of 4 rows and 4 columns, FIG. 8*b* shows a matrix of 8 rows and 8 columns and FIG. 8*c* shows matrix of 16 rows and 16 columns.

In the matrix of FIG. 8*a*, when (x)=(1, 1, 1, 1), the maximum displacement of y (the maximum value of $\Delta y_i$) is 0. On the other hand, since L is 4, the condition A is "$\Delta y_i < 2.8$". In the matrix of FIG. 8*b*, when (x)=(1, 1, . . . , 1), the maximum displacement of y (the maximum value of $\Delta y_i$) is 4, as shown in the figure. On the other hand, since L is 8, the condition A is "$\Delta y_i < 5.6$". In the matrix of FIG. 8*c*, when (x)=(1, 1, . . . , 1), the maximum displacement of y (the maximum value of $\Delta y_i$) is 8, as shown in the figure. On the other hand, since L=16, the condition A is "$\Delta y_i < 11.2$". Accordingly, the condition A is satisfied in all the cases.

FIG. 9 shows a still another example of the matrix described above. FIG. 9 shows a matrix of 7 rows and 8 columns. When (x)=(1, 1, . . . , 1), the maximum displacement y (the maximum value of $\Delta y_i$) is 2 as shown in the figure. On the other hand, since L=7, the condition A is "$\Delta y_i < 4.9$". Accordingly, the condition B is "$\Delta y_i \leqq 3.5$". Accordingly, this matrix satisfies not only the condition A but also the condition B.

The waveform pattern in this case is shown in FIG. 1*a* wherein an arbitrary unit is used for the column electrode waveform in a state of an entirely ON display. From the Figure, it is understood that the variation of the maximum voltage is very small in comparison with the waveform in FIG. 2 which is the case of using the Hadamard's matrix as the selection matrix.

A case that the selection pulse sequence is used in the method (1) is considered. The selection pulse sequence is not always in agreement with the order of the column vectors in the selection matrix when the sequence is shifted from the last subgroup to the first subgroup. For instance, in the example of formula 3, a column vector A2 is applied after a column vector Ap has been applied. In this case, Ap relies on the number of the subgroups. In such a case, the column voltage sequence may not satisfy in a strict view, as a whole the above-mentioned conditions even tough the selection matrix satisfies the conditions.

Even in this case, it can be said that the above-mentioned conditions can be substantially satisfied by the column voltage pulse sequence as a whole when the selection matrix satisfies the conditions. For instance, when the number of scanning lines is 240 or more and the number of scanning lines to be simultaneously selected is 16 or less, the number of the subgroups is 30 or more. Accordingly, even when a large distortion of waveform is resulted in the transition from the last subgroup to the first subgroup, it influences only 1/30 or less in the entirety of the variation of voltage. Accordingly, the variation of the effective value of voltage is relatively small.

Namely, the present invention requires that the column electrode voltage sequence vectors in a period in which all the subgroups are selected satisfy the above-mentioned condition. This condition can be expressed as shown in formula 4 which is a similar expression to formulas 1 and 2, provided that the selection pulse sequence of the method (1) is used.

$$(B) = (x_1, x_2, \ldots, x_p) \begin{bmatrix} A_1 & Z_e & Z_e & \ldots & Z_e \\ Z_e & A_2 & Z_e & \ldots & Z_e \\ Z_e & Z_e & A_3 & \ldots & Z_e \\ . & . & . & & . \\ . & . & . & & . \\ . & . & . & & . \\ Z_e & Z_e & Z_e & \ldots & A_p \end{bmatrix} \quad \text{Formula (4)}$$

In an embodiment of the present invention, an uneven display can be reduced by inverting the polarities of the applied voltages at an appropriate timing. When the polarities are inverted at a predetermined period, a d.c component can be removed even when any type of orthogonal matrix is used as the selection matrix. Further, the frequency band region in which there is the center of the driving waveform can be controlled by adjusting the period of polarity inversion. When the frequency band region is too low, an uneven display or a flicker may be resulted depending on a display pattern. However, such disadvantages can be removed by the inversion of the polarities of voltages. It is very effective to invert the polarities at the time when the driving frequency is relatively low. The matrix shown in FIG. 9 is an example of the selection matrix which lowers the driving frequency of the column waveform.

It is desirable to invert the polarities at the time point that the column voltage sequence is in a level near 0 because the variation of the effective value due to the distortion of the waveform which is resulted by the polarity inversion can be minimized. Specifically, it is preferable that the column electrode voltage levels $y_{j-1}$ and $y_j$ before and after the time of the polarity inversion with respect to the number L of simultaneously selected rows satisfies the following relations:

$|y_{j-1}| \leqq 0.5 \cdot L$ and $|y_j| \leqq 0.5 \cdot L$ where j−1 and j are respectively affix letters indicating just before and just after the polarity inversion.

More preferably, the above-mentioned relations can be expressed as follows:

$|y_{j-1}| < 0.3 \cdot L$ and $|y_j| < 0.3 \cdot L$ where j−1 and j are respectively affix letters indicating just before and just after the polarity inversion.

When the column electrode voltage levels satisfy the conditions, influence to the variation of the effective value of voltage at the time of the polarity inversion is minimized.

These conditions can be achieved with use of an appropriate selection matrix and by inverting the polarities of voltage at a timing satisfying the above-mentioned relations. In the matrix shown in FIG. 9, for instance, a preferable timing of the polarity inversion to satisfy the conditions is between the application of voltage of the eighth column vector and the first column vector or between the first column vector and the second column vector. The polarity inversion at such timing suppresses influence to the distortion of the waveform and provides a picture image free from crosstalk in comparison with the conventional driving method.

Further, it is desirable that the difference of the column voltage levels before and after the polarity inversion satisfies a relation $|y_{j-1}-y_j| < 0.7 \cdot L$, preferably, $|y_{j-1}-y_j| \leqq 0.5 \cdot L$. Thus, the distortion of the waveform of column voltage at the time of polarity inversion and the distortion of the waveform of the column voltage at the time of the variation of the column voltage can be reduced to thereby contribute the elimination of the uneven display.

Further, in the present invention, when (x)=(1, 1, 1, 1, . . . 1), the polarities of the column electrode voltage sequence vectors are inverted just after each step in which the values |y| are equal, it is preferable to effect the periodical polarity inversion wherein the step corresponds to the application of each row electrode selection pulse. Thus, the distortion of the waveform due to the polarity inversion can be controlled and the crosstalks can be effectively reduced.

For instance, FIG. 1*b* shows a waveform obtained in a case that the matrix shown in FIG. 9 is used as a selection matrix, which is subjected to polarity inversion every 8 steps. In the waveform shown in FIG. 1*b*, an arbitrary unit is used for the column electrode waveform in a state of an entirely ON display. From the FIG. 1*b*, it is understood that in comparison with the waveform shown in FIG. 2 in which the Hadamard's matrix is used as the selection matrix, the variation of the maximum voltage is very small, and the frequency of the driving waveform is low as a whole. Namely, the waveform shown in FIG. 1*b* is very effective to reduce the crosstalk since the rate of occurrence of a distortion of waveform is substantially reduced. For the polarity inversion with every 8 steps, it is possible to conduct the polarity inversion with a multiple of 8 such as 16 steps or 24 steps.

Further, in the present invention, it is preferable in particular to satisfy the following condition. In a column electrode voltage sequence $(y_1, y_2, \ldots, y_N)$ to (x)=(1, 1, . . . , 1), when the number of selection pulses in a display cycle on a specified row electrode is K, the application of a row electrode selection pulse is deemed as one step, and the tie period from the time at which the sign is changed from negative to positive to the next time point at which the sign is changed from negative to positive is made correspondent to K steps. K may be the number of columns in the selection matrix A so as to perform the polarity inversion at a timing that the variation of the voltages can be minimized. In such matrix, a direct current component leaving in a display cycle is small. Accordingly, it is possible to control unevenness in a low frequency such as an uneven Vth of liquid crystal. In the matrix, particularly, the direct current component can be completely removed by arranging vectors so that the sings are symmetric (i.e. the number of positive and negative signs of elements in each row vector is equal).

Specifically, it is enough to make the number of positive and negative signs in each row vectors in the selection matrix equal. In this case, the addressing operations and the removal of the direct current components are completed in one display cycle either from the viewpoint of the effective value or from the viewpoint of the formation of an alternating current. Accordingly, the occurrence of an uneven display due to a lower frequency component or an uneven display due to the interference by a plurality of frequency components can be effectively controlled.

An example of such matrix is shown in FIG. 10. FIG. 10 shows a matrix of 7 rows and 8 columns. When (x)=(1, 1, . . . , 1), the maximum displacement of y (the maximum value of $\Delta y_i$) is 2 as shown in the figure. On the other hand, since L=7, the condition A is $\Delta y_i<4.9$, and the condition B is $\Delta y_i<3.5$. Accordingly, this matrix satisfies not only the condition A but also the condition B.

The waveform pattern in this case is shown in FIG. 1*d*, wherein an arbitrary unit is used for the column electrode waveform in a state of an entirely ON display. It is understood that the variation of the maximum voltage is small in comparison with the waveform in FIG. 2 which is the case of using the Hadamard's matrix as the selection matrix.

In accordance with the second embodiment of the present invention, the matrix (S) as the standard to select the optimum column waveform from the standpoint that the width of the variation of the maximum voltage along the time axis (the order of progressing the sequence) is evaluated by formula 3.

The inventors of this application have found that the following elements are factors to control crosstalks:

(1) a kind of selection matrix, (2) a selection pulse sequence (a method of dispersing selection pulses), and (3) replacement of rows and columns in the selection matrix.

Namely, it is necessary to suitably determine the above-mentioned factors (1) to (3) in order to suppress the crosstalks in various kinds of patterns such as a flat display, a dynamic display and so on. The inventors have noted a data conversion by the matrix S in consideration of the factors (1) to (3), and have found that the matrix S, the selection matrix A as the origin of the matrix S and the selection pulse sequence can efficiently improve the quality of displays (in particular, control crosstalks). Thus, this embodiment of the present invention is provided.

In the second embodiment of the present invention, two kinds of patterns: (x)=(1, 1, . . . , 1) (a reference pattern 1) and (1, −1, 1, −1, . . . ) (a reference pattern 2) are selected for column electrode display pattern vectors (x). In the ordinary binary display, a state nearly entirely ON or entirely OFF (e.g., a pattern in which a block or a line exists on a uniformly flat pattern) is mainly used. Or, in a gray shade display or a dynamic display, a state of display having a further high spatial frequency mainly used. In order to reduce the crosstalk in the patterns having fundamentally different spatial frequencies, it is important to use the above-mentioned two reference vectors and to determine the factors (1) to (3). With this a picture image free from the crosstalk can be provided regardless of kinds of picture image.

Generally, the difference of the variation of the maximum voltages can be suppressed to a practically applicable extent by determining the above-mentioned reference vectors to be $\Delta y_{MAX1}+\Delta y_{MAX2}<1.4\cdot L$ (hereinafter, referred to as a condition C), more preferably, $\Delta y_{MAX1}+\Delta y_{MAX2}\leqq L$ (hereinbelow, refereed to as a condition D) where $\Delta y_{MAX1}$ represents the maximum value of the difference of the variation of the column voltages to the reference pattern 1, and $\Delta y_{MAX2}$ represents the maximum value of the difference of the variation of the column voltages to the reference pattern 2.

A column electrode waveform obtained by using a conventionally used Hadamard's function will be examined. The selection pulse sequence according to the method (1) is described. FIG. 18*c* is an Hadamard's matrix of 7 lows and 8 columns. When (x)=(1, 1, . . . , 1), to the reference pattern 1, $(y)_1$=(7, −1, −1, . . . , −1, 7, −1, . . . ), and the maximum displacement (the maximum value of $\Delta y_i$) is 8.

When (x)=(1, −1, 1, −1 . . . ) to the reference pattern 2, $(y)_2$=(1, 7, 1, −1, 1, −1, 1, −1, 1, 7, 1, . . . ), and the maximum displacement (the maximum value of $\Delta y_i$) is 6, wherein affix letters to (Δy) represent either the reference pattern 1 or the reference pattern 2. As described above, since the method (1) is used for the sequence, it should be noted that the reference pattern to the second, fourth, sixth and eighth columns has (−1, 1, −1, 1, ..) from the first row because the number of rows in the selection matrix is an odd number (i.e. 7).

On the other hand, since L=7, the condition A is $\Delta y_{MAX1}+\Delta y_{MAX2}<9.8$. In this case, $\Delta y_{MAX1}+\Delta y_{MAX2}=14$, and the condition C is not satisfies. Namely, when the Hadamard's matrix is used as the selection matrix, the variation of the maximum voltage is large either to a display pattern of a low frequency or a display pattern of a high frequency, whereby the effective value is reduced due to the distortion of the waveform.

The waveform pattern in this case is shown in FIG. 17 wherein FIG. 17*a* shows the waveform of column voltages in an entirely OFF display and FIG. 17*b* shows the waveform of column voltages in an ON/OFF display, wherein an arbitrary unit is used. There are found large periodical variations of voltage.

Although the two reference patterns are fundamentally different in terms of spatial sequence, it is possible to determine suitably the matrix S for both the two reference patterns. First, the selection matrix (an orthogonal function) is prepared as reference. In this case, it is desirable that the signs of adjacent column elements are agreed with each other because the pattern dependence to the column voltage sequence can be controlled. For this, it is desirable that the total number F of a number of the elements wherein the adjacent column elements 1 and 2, 2 and 3, ..., k and 1) in the matrix A have the same sign has the relation of $F\geqq L\times K/2$ to the matrix of L×L. When the above-mentioned condition is satisfied, the pattern dependence to the column voltages can be reduced.

Based on the selection matrix, the matrix S is prepared to comply with the vector sequence. Column voltages are calculated with respect to the two reference patterns, and the original matrix A is transformed so that the variation of the voltage levels satisfies the condition C, preferably, the condition D. As a method of the transformation, there is the replacement of rows, the replacement of columns or the inversion of the sign of rows and/or columns which can be done without damaging the orthogonality of the matrix.

In the case of the matrix of 7 rows and 8 columns, a 7!×8!number matrices can be obtained with respect to an original matrix. This means that there is more than 20 millions of combination. In a large number of matrices, the matrix A is optimized through a filter such as two reference patterns.

FIG. 19 shows an example of the selection matrix (A) i.e. a matrix of 7 rows and 8 columns, suitable for practicing the present invention. When $(x)=(1, 1, \ldots, 1)$, $(y)_1=(-1, 1, -1, -3, -3, -5, -3, -1)$, and the maximum displacement (the maximum value of $\Delta y_i$) is 2. Further, when $(x)=(1, -1, 1, -1, \ldots)$, $(y)_2=(1, 1, 1, 5, 3, 1, 3, -1)$, and the maximum displacement (the maximum value of $\Delta y_i$) is 4. On the other hand, since L=7, the condition A is a $y_{MAX1}+\Delta y_{MAX2}=6<9.8$. Accordingly, the matrix satisfied the condition C at the time of the maximum displacement.

Further, since 6<L=7, it satisfies the condition D. In this matrix, the number F in which the codes of adjacent column elements are agreed with each other is 30, whereby the matrix satisfies the relation of $F \geqq L \times K/2=28$. In the above-mentioned Hadamard's matrix, the value F is 24, which does not satisfy the relation.

FIGS. 16*a* and 16*b* are diagrams showing the variation of column voltages wherein FIG. 16*a* concerns the display of an entirely OFF state and FIG. 16*b* concerns a display of ON/OFF. In comparing FIG. 16 with FIG. 17 showing the application of Hadamard's matrix, it is understood that the variation of column voltages is small in either of the patterns.

FIG. 20 shows another example of the selection matrix applicable to the present invention.

In the matrix shown in FIG. 20*a*, the maximum displacement on the reference pattern 1 is 2 and the maximum displacement on the reference pattern 2 is 4. In comparing with FIG. 7, the same maximum displacement is provided although the formation of the matrix is different. In the matrix shown in FIG. 20*b*, the maximum displacement on the reference pattern 1 is 2, and the maximum reference displacement on the reference pattern 2 is 6. The sum of both is 8 which is smaller than 9.8, and accordingly, the matrix satisfies the condition C.

In a case of progressing the selection pulse sequence according to the method (1) and when the sequence is shifted from the last subgroup to the first subgroup, the selection pulse sequence does not always agree with the order of the column vectors of the selection matrix in the same manner as in the first embodiment. Even in this case, however, there is no problem of the crosstalk in the same manner as in the first embodiment.

In the second embodiment, an uneven display can be reduced by inverting the polarities of applied voltages at an appropriate timing. Namely, it is desirable that the column electrode voltage levels $y_{j-1}$ and $y_j$ before and after the timing of effecting the polarity inversion satisfy the following relations with respect to the number L of the simultaneously selected rows:

$|Y_{j-1}| \leqq 0.5 \cdot L$ and $|Y_j| \leqq 0.5 \cdot L$ (j−1 and j are affix letters indicating just before and just after the polarity inversion respectively). Preferably, the above-mentioned relations can be expressed as follows:

$Y_{j-1}|<0.3 \cdot L$ and $|Y_j|<0.3 \cdot L$ (j−1 and j are affix letters indicating just before and just after the polarity inversion respectively).

When any matrix satisfies the conditions, influence to the effective value at the time of polarity inversion can be minimized.

These conditions can be practiced by using an appropriate selection matrix and inverting the polarities of applied voltages at a timing of satisfying the above-mentioned relations.

In the matrix shown in FIG. 19, the timing of the polarity inversion between the application of voltage of the eighth column vector and the first column vector or between the first column vector and second column vector satisfies the conditions. The polarity inversion having such timing suppresses the influence of the distortion of waveform in comparison with the conventional driving method, and provides a picture image having little crosstalk.

In the same manner as the first embodiment, the difference of the column voltage levels before and after the polarity inversion should satisfy a relation $|y_{j-1}-y_j|<0.7 \cdot L$, preferably $|y_{j-1}-y_j| \leqq 0.5 \cdot L$ on both the reference pattern 1 and the reference pattern 2, whereby the distortion of the column voltages at the time of the polarity inversion and the distortion of the column voltages at the time of column voltage variation can be reduced to thereby contribute effectively to minimize an uneven display.

In the following, the relation of the polarity inversion and the variation of column voltage levels will be described.

In the most suitable bias method in the conventional successive line driving method, the relation between the row selection voltage level Vr (>0) and the column voltage level Vc (>0) is Vc=Vr/B (where B=VN). Accordingly, the variation of the voltage level at the time of the polarity inversion is 2Vc=2Vr/B. In the multiple line selection method, there are a plurality of (L+1) number of column voltage levels wherein a relation of Vc=L/B·Vr is established with respect to the maximum level.

From the above-mentioned relations, the width of the variation of the column voltage levels at the time of the polarity inversion in the following four driving methods (1) to (4) is shown in Table 2:

(1) the conventional successive line driving method, (2) the multiple line selection method using an Hadamard's function (FIG. 18(*c*)), (3) the multiple line selection method of the present invention (FIG. 20 (*b*), and (4) the multiple line selection method of the present invention (FIG. 19). In these methods, it is supposed that the total number of row electrodes is 240, the number of simultaneously selected rows in the successive line driving is 1, the number of simultaneously selected rows in the multiple line selection driving method is L =7, and the polarity inversion is effective between the eighth column and the first column of the selection matrix, (i.e. between the eighth column voltage vector and the first column electrode vector) in the multiple line selection method.

TABLE 2

| Driving method | Width of variation of column voltage/$V_r$ |
|---|---|
| (1) | $2V_c/V_r = 2/240 = 0.129$ |
| (2) Entirely OFF | $\Delta V_c/V_r = 7/240 \cdot (8/7) = 0.516$ |
| ON/OFF | $\Delta V_c/V_r = 7/240 \cdot (6/7) = 0.387$ |
| (3) Entirely OFF | $\Delta V_c/V_r = 7/240 \cdot (2/7) = 0.129$ |
| ON/OFF | $\Delta V_c/V_r = 7/240 \cdot (6/7) = 0.387$ |
| (4) Entirely OFF | $\Delta V_c/V_r = 7/240 \cdot (2/7) = 0.129$ |
| ON/OFF | $\Delta V_c/V_r = 7/240 \cdot (4/7) = 0.258$ |

In order to evaluate the quantity of the actual crosstalks, it is important to take the absolute value of the variation of the column voltages into account. In this case, it is noted that the selection voltage Vr in the multiple line selection method is lower than that in the successive line driving method. In the above-mentioned example, Vr in the multiple line selection method is ½ or less Vr in the successive line driving method. Namely, the magnitude of the variation due to the polarity inversion of the column electrode voltages introduced by the above-mentioned relations in a case of the driving method (3) is ½ or less in the case of the driving method (1). The fact implies that the use of the polarity inversion method of the present invention provides little influence to the variation of the effective value even when the distortion of the waveform at the time of the polarity inversion takes place, and a display of excellent uniformity is achieved in comparison with the conventional successive line driving method.

Further, in the present invention, when (x)=(1, 1, 1, 1, . . . 1), the polarities of the column electrode voltage sequence vectors are inverted just after each step in which the values |y| are equal, it is preferable to effect the periodical polarity inversion wherein the step corresponds to the application of each row electrode selection pulse. Thus, the distortion of the waveform due to the polarity inversion cn be controlled and the crosstalks can be effectively reduced.

Further, in the present invention, it is preferable in particular to satisfy the following condition. In a column electrode voltage sequence ($y_1$, $y_2$, . . . , $y_N$) to (x)=(1, 1, . . . , 1), when the number of selection pulses in a display cycle on a specified row electrode is K, the application of a row electrode selection pulse is deemed as one step, and the time period from the time at which the sign is changed from negative to positive to the next time point at which the sign is changed from negative to positive is made correspondent to K steps. In such matrix, a direct current component leaving in a display cycle is small. Accordingly, it is possible to control uneveness in a low frequency such as an uneven Vth of liquid crystal. In the matrix, particularly, the direct current component can be completely removed by arranging vectors so that the sings are symmetric (i.e. the number of positive and negative signs of elements in each row vector is equal).

Further, in the present invention, it is preferable to use a matrix wherein the frequency of the voltages in the simultaneously selected rows is substantially equal. When the frequency is different from every row electrodes, the magnitude of crosstalks is also different to thereby cause an uneven display for each row electrode. However, such disadvantage can be eliminated.

In the multiple line selection method, when one display cycle becomes long, there is a possibility of causing another type of deterioration in a display due to a lower frequency component. As an example, there are the unevenness of Vth which is resulted from a decrease of the threshold voltage Vth characteristics of a liquid crystal display element in a lower frequency region, a flicker due to a lower frequency component and so on.

From these standpoint, it is not desirable that a display cycle is too long. For this, the row electrode pulse sequence matrix (S) should satisfy the relation of $N \leqq 4M$, more preferably, $N \leqq 3M$. For instance, when 240 row (selection) lines are driven with an L=7 number of simultaneously selection lines, 35 subgroups are formed, and the length of a display cycle corresponds to a selection pulse width×N= selection pulse width×$N_s$×K.

Here, when the row electrode selection matrix (A) is constituted by 7 rows (=L) and 24 columns (=K), the length of the cycle is the pulse width×35×24=the pulse width×840. Accordingly, the length is 25 ms (40 Hz) to the pulse width=30 μs, and the length is 33 ms (30 Hz) to the pulse width=40 μs. Thus, a display can be provided without suffering the influence of the lower frequency component.

FIG. 8*a* shows an example of the optimized matrix of 4×4 in consideration of the above-mentioned conditions. In particularly, the matrix described below can be exemplified as the optimized matrix of 4×4 in which columns are replaced.

With the matrix, there are produced column signals which minimizes the variation of voltages wherein the column electrode voltage levels are fundamentally the same with respect to the reference pattern 1, and the voltage levels are changed once in a range between +2 and −2 with respect to the reference pattern 2.

Another feature of the matrix resides in that the number of signs is the same in each of the row vectors (in the above-mentioned example, the number of positive signs is 3 and the number of the negative sign is 1). This means that the same selection waveform except for only the phase can be obtained for each line in the simultaneously selected row electrode groups (subgroups), and the occurrence of the unevenness of bright and dark between the lines can be fundamentally suppressed. The other types of orthogonal matrix can not provide such matrix wherein the sequence of each row vectors is the same except for the phase, and therefore, some corrections of the unevenness between the lines are necessary. On the other hand, in the present invention, each line can be driven by an equivalent driving except for the phase by selecting a four number of simultaneously selected lines and determining the ratio of the number of sings of the elements of each row vectors being 1:3 (or 3:1). The above-mentioned matrix is the most desirable example. However, another suitable matrix can be obtained by replacing a row or rows, or a column or columns, or inverting the polarities of the row(s) or the column(s).

Other feature of the matrix wherein L=4 resides in that the variation of voltages can completely be eliminated with respect to a flat display pattern. Since the number of signs of the elements in the column vectors of the matrix is equal, the column signal voltages can be common to all 4 column vectors. The fact that there is no fluctuation in the column voltages on all the column vectors means that the polarity inversion can be made in non-synchronism with the vector sequence. In the conventional method of using the other orthogonal matrix, the polarity inversion could not be performed without synchronizing with the column vector sequence since the voltage level of the column signals varied for each column vectors of the orthogonal matrix. Accordingly, the flexibility of driving was small; the driving method was complicated and the construction of the circuit for driving was also complicated. On the other hand, in the present invention, the polarity inversion is possible in a non-synchronous manner, and it can be performed with a simple counter. Further, the period of the polarity inversion can be selected in a very wide range. Actually, it is preferable to determine a period of polarity inversion in which the length of the period is an odd number times of the selection pulses in a range from 3 to 50, from the viewpoint that the polarity inversion should be made for all the subgroups. More preferably, the number of selection pulses is of an odd number between 3 and 40. The reason why use of an uneven number is undesirable, is because when the matrix of L=4 is used, there is a high possibility of impairing the driving characteristic in an alternating current form since the selection pulses are supplied four times to each of the subgroups in one frame. The period of polarity inversion is desirably selected from 5, 7, 9, 11, 13 and 23.

It is important that values M and L satisfy a suitable relation with respect to the polarity inversion and the selection vector sequence. For instance, when the number of rows M is 240 and L=4, the number of the subgroups is 60 (240/4=60). When the polarity inversion occurs every 5 pulses, the polarity inversion takes place at fixed positions because 60/5=12, and an alternating current form can not be obtained. Accordingly, in order to drive the 240 lines with the polarity inversion at every 5 pulses, it is necessary to change the above-mentioned situation by adding an imaginary line(s). For instance, the number of subgroups can increase to 61 (the number of lines=244) so that the polarity inversion can be effected with a period of 5 pulses.

A condition to be satisfied is that one between the number of subgroups Ns and the period of the polarity inversion (S pulses) is not a divisor of the other. For this, it is necessary to satisfy the condition by adding an imaginary line(s), for instance. The other condition to be satisfied is that the period of the vector sequence is different from the period of the polarity inversion. For instance, the period S of the polarity inversion should not be a multiple of 4.

In the next, description will be made of the driving method (selection matrix) of the present invention in comparison with Hadamard's functions and pseudrandom functions which are function systems known as the selection matrix used for the driving method.

In the selection matrix using the Hadamard's function (Hadamard's matrix), an uneven display is apt to cause since the maximum displacement of (y) is large as described before, and a slight shift or a distortion of the waveform from an ideal waveform causes a large variation in the effective value, whereby an uneven display is easily caused. Accordingly, use of the Hadamard's matrix reduces the quality of display in comparison with the driving method of the present invention.

On the other hand, a big problem in the pseudrandom function resides in a lack of orthogonality (the product of row vectors being 0) among row vectors of the selection matrix. When arbitrary row vectors in a pseudrandom matrix are $\alpha_i$ and $\alpha_j$ (i=1 to L and j=1 to L), the absolute value of the inner product is 1 in i=k and 1/L in i ≠k.

Namely, a substantially orthogonal relation can be established when L has a very large value. However, when such matrix is used as a selection matrix in a case of L =3, 4, 7 or 8 in partial line selection, the confusion of information is resulted due to the lack of the orthogonality to thereby result an additional cause of crosstalks. When there is no orthogonality, there is confusion of ON/OFF information on pixels, and the effective values on pixels in an ON state and pixels in OFF state are in no agreement with each other.

The other problem in a case of using the pseudrandom function as the selection matrix resides in the length of cycle. In the pseudrandom function, a $(2^L-1)$ of columns are required for an L number of rows in the selection matrix. For instance, K=255 for L=7. In this case, the quality of display will decrease due to a low frequency component as described before.

Thus, in the pseudrandom function, when L is small, the orthogonality of the matrix is lost. On the other hand, when L is large, there are many drawbacks due to the large length of cycle in comparison with the driving method of the present invention. In a partial multiple line selection method, it is preferable that the number of simultaneous selection is $3 \leqq L \leqq 16$ from the viewpoints of the characteristics such as high contrast and the simplicity of the driving circuit system. Thus, it is clearly understood that the driving method of the present invention is superior to a method of using the Hadamard's matrix or the pseudrandom matrix as the selection matrix.

<Matrix including dummy row lines>

In the MLS method, there are many cases of using an imaginary row electrode or electrodes other than the row electrodes which are actually formed on a substrate. One of the reasons is as follows. When row electrodes are selected simultaneously with a number which is smaller than the total number of electrodes, the total number of row electrodes can not always be divided by the number of simultaneously selected row electrodes. In this case, a dummy electrode or electrodes are considered so that the total number of electrodes can be divided by the number of simultaneously selected row electrodes. Namely, row electrode signals are operated for driving on the assumption that there is a dummy electrode in a row electrode subgroup which is short in the number of the row electrodes. In the study by the inventors, they have found that unevenness of display takes place at a position near such dummy electrode. In particular, the problem of unevenness of display is often caused when vertically divided two picture surfaces (display screens) are formed to be driven: that is, so-called, the dual scan. When the dummy electrode is arranged at the center of a picture surface, the unevenness of display appears as a black stripe or a white stripe along the direction of the row electrodes, whereby it becomes conspicuous in display.

The embodiment described below is to reduce the unevenness of display.

When a picture display device having a plurality of row electrodes and a plurality of column electrodes is driven by selecting simultaneously a plurality of row electrodes the number of which is smaller than the total number of row electrodes of the display device, an imaginary row electrode or electrodes are included in at least part of row electrodes, and data on the imaginary electrode or the electrodes are used as variable data corresponding to column electrode signals. In this case, of course, the picture display device may include a group having an L number of row electrodes which are formed of imaginary electrodes only.

In the driving method for the picture display device, the variable data are so selected from ON or OFF that the variation of the voltages having the data on the column electrodes is small. Further, the variable data are made coincident with the data on the column electrodes near the imaginary electrode.

Namely, the unevenness of display can be remarkably decreased by rendering the display data on the imaginary electrode to be variable, in particular, by selecting the variable data from ON or OFF so that the variation of the voltages having the data on the column electrodes is small, or making the imaginary data coincident with the data on the scanning electrodes near the imaginary electrodes.

In an embodiment of the present invention, the variable data can be selected from ON or OFF so that the variation of the voltages having the data on the column electrodes is small.

Regarding such embodiment, the column electrode waveform in a case using an Hadamard's function as the selection matrix is examined.

FIG. 25*a* shows an Hadamard's matrix of 7 rows and 8 columns (it is formed by subtracting the first row from an Hadamard's matrix of 8 rows and 8 columns). When the entirely OFF display (x)=(1, 1, . . . , 1) is provided, the column voltage levels are (y)=(7, −1, −1, ..., −1), and the maximum displacement ($\Delta y_i$=the maximum value of $|y_{i+1}-y_i|$ is 8. Accordingly, when the Hadamard's matrix is used as the selection matrix, the maximum variation of the column voltage at the time of the entirely OFF display is large, and it substantially reduces the effective value due to the distortion of the waveform to thereby cause an uneven display.

FIG. 25*b* shows the waveform pattern having a large variation of voltages in the entirely OFF state wherein the waveform of the column voltages is shown with an arbitrary unit. There is found a large periodical change of voltage.

According to the present invention, one of simultaneously selected row electrodes (for instance, the seventh row electrode is selected) is supposed to be a the dummy electrode. As display data (dummy data) on the dummy electrode, when vectors (–, 1, 1, –1, 1, –1, –1, 1) are used as selection pulses to be applied, the column voltage levels become (y)=(5, 1, 1, ... 1), and the maximum value (the maximum of $\Delta y_i$) of the variation of the column voltages is 4. FIG. 25c shows a waveform pattern of the variation of the column voltages. From the Figure, it is found that the magnitude of the displacement of the column voltages is reduced by using suitable dummy data for a dummy row.

FIG. 26a shows another example of an orthogonal selection matrix (B). FIG. 26a is a matrix of 7 rows and 8 columns. When the entirely OFF display including a dummy row is expressed by (x)=(1, 1, . . . . 1), the column voltage levels become (y)=(5, 1, 1, –3, –3, –3, 1, 1), and the maximum value of the variation of the column voltages (the maximum of $\Delta y_i$) is 4 (FIG. 26b).

In this case also, one of the simultaneously selected row electrodes (e.g., the 7the row electrode is selected) is used as a dummy electrode. When vectors (–1, 1, 1, 1, 1, 1, 1, –1, –1) are used for selection pulses to be applied as dummy data, the column voltage levels to an entirely OFF display in the actual electrodes are (y)=(3, 3, 1, –1, –1, –3, –1, 1), and the maximum value of the variation of the column voltages (the maximum of $\Delta y_i$) is 2. FIG. 26c shows a waveform pattern in this case. It is found that the width of the displacement of the column voltages is decreased by using appropriate dummy data for the dummy row.

The above-mentioned description concerns the reduction of an uneven display by selecting the dummy data in a case of an entirely OFF (or entirely ON) display. However, when another display pattern is to be used, ON or OFF can suitably be selected for the data so that the variation of the column voltages becomes small. Namely, the magnitude of the variation of the column voltages is compared in both cases that ON is used for the dummy data and OFF is used for the data, and display data on the dummy electrode are selected so as to reduce the variation of the column voltages, whereby a non-uniformity of a display due to the determination of data on the dummy row can be controlled with respect to all kinds of display patterns.

In another embodiment of the present invention, the imaginary data are made coincident with data on row electrodes near the imaginary electrode. As described before, a display pattern of practically important such as a window display is a pattern which is substantially entirely ON or entirely OFF. In this case, it is generally desirable to use a function so as to minimize an uneven display. In considering the above, the coincidence of imaginary data with data on a row electrode in the vicinity of an imaginary electrode effectively reduces the uneven display because it further approaches the pattern of entirely ON or OFF.

The imaginary electrode does not actually exist. However, in many cases, the position of the imaginary electrode can be identified on a display picture. It is because, by taking an advantage of designing circuits, a selection pulse sequence can be applied with a certain regularity, and simultaneously selected row electrodes can be arranged with a certain regularity on the actual picture surface.

FIG. 22 shows an example of a case that simultaneously selected row electrodes are arranged as a batch on an actual picture surface wherein the number of actual scanning lines is 14, the number of simultaneously selected row electrodes is 3 and the number of independent selection pulses is 4 (A1 to A4). Supposing that row electrodes are selected from the upper portion of the picture surface by advancing the selection pulses by 1 every time when row subgroups are selected. Then, the selection pulses are applied to a subgroup 3 in the order of A3, A4, A1, A2 . . . . The selection pulses are compared with the selection waveform actually applied, whereby it is possible to recognize the row electrode as the imaginary electrodes. And, in the consideration that the simultaneously selected row electrodes are arranged as batch with regularity on the actual picture surface, the imaginary electrode 3-3 can be deemed to be at a position between the 8th row and the 9th row on the actual picture surface.

Similarly, FIG. 23 shows an example that simultaneously selected row electrodes are dispersively arranged on an actual picture surface. In the same manner as above in this case, it is possible to consider that the imaginary electrode is inserted between the 12th row and the 13th row in the actual electrodes.

The terms "in the vicinity of the imaginary electrode" means a near position in the order of scanning. For instance, when a display surface is scanned from the upper portion to the lower portion, and an imaginary electrode is positioned at the lowest portion of the display surface, the uppermost portion of the display surface can be "in the vicinity of the imaginary electrode" because the uppermost portion is scanned in the next of the lowermost portion of the display surface.

In the next, explanation will be made in detail as to how imaginary data are made coincident with data on a row electrode in the vicinity of an imaginary row electrode. In a case shown in FIG. 22, for instance, the imaginary electrode is at a position of 3-3. Accordingly, the data of the imaginary electrode should be corresponded to the data on the position 3-2 or 3-1.

The data of the imaginary electrode may be made coincident with the data for the next subgroup adjacent to the imaginary row electrode. In the case shown in FIG. 22, wherein the imaginary row electrode is at the position 3-3, for instance, the data of the imaginary row electrode should be made coincident with either data on row electrodes of 2-1 or 2-3. Further, the data on the imaginary row electrode may be made coincident with the data on the just before of the subgroup adjacent to the imaginary electrode in the case as shown in FIG. 22. For instance, the data of the imaginary electrode should be made coincident with the data on any of the row electrodes 4-1to 4-3 since the imaginary electrode is at the position 3-3. In the case of the FIG. 23, wherein the groups of row electrodes simultaneously selected are dispersively arranged on the display substrate, the data for the imaginary electrode 3-3 should be selected any of the row electrodes 1-3, 2-3, 4-3 and 5-3.

In such a case, when there are a plurality of imaginary electrodes, it is preferable to dispersively arrange the electrodes on the picture surface. The unevenness of display due to the provision of the imaginary electrodes can be dispersed to thereby improve the quality of display.

As another easy method, the imaginary row electrodes may be arranged at a portion or portions in the picture surface so that the unevenness of display is not conspicuous, whereby th unevenness can be remarkably reduced as a whole.

In the present invention wherein two picture surfaces are driven, the position of the imaginary electrode or electrodes may be determined at upper and/or lower portions of the picture surfaces, whereby the unevenness of display caused by the position of the electrode or electrodes can be substantially reduced.

Namely, when the imaginary electrode is to be arranged at an end of the picture surface in the case of FIG. 22 for instance, the imaginary electrode is included in the first subgroup, and the row electrodes can be driven with such a sequence that the row electrode at the position 1-1 is the imaginary electrode. Similarly, in the case of FIG. 23, the imaginary electrode is included in the first subgroup, and the row electrode are driven with such a sequence that the row electrode at the position 1-1 is the imaginary electrode.

According to the present invention, the imaginary electrode or electrodes are dispersed in a plurality of row electrode subgroups, the unevenness of display caused by the provision of the imaginary electrode or electrodes is dispersed, and an improvement of the quality of display can be expected.

Further, in the case that the simultaneously selected row electrode are treated as a batch as shown in FIG. 22, a fairly good result is obtainable for the reduction of the unevenness of display by merely arranging the row electrode subgroup including the imaginary electrode at an end (upper or lower) of the picture surface.

Further, in the present invention, it is preferable that each of the picture surface be scanned from the boundary portion between the two picture surfaces toward the opposite end of each of the picture surfaces. Namely, there are two picture surfaces in the vertical direction. Scanning is conducted from the upper portion to the lower portion for the upper picture surface, and scanning is conducted from the lower portion to the upper portion for the lower picture surface. The reason is as follows. The variation of the column voltages caused by the imaginary electrode gives influence to the subgroup to be scanned next. Accordingly, it is advantageous to determine the position at the last of the scanning. Why the variation of the column voltage influences the subgroup to be scanned next is that a distortion of the waveform is caused in the next subgroup so that the distortion of the waveform restores the distortion of the waveform caused in the subgroup including the imaginary electrode.

<Embodiment of a circuit to practice the present invention>

The driving method of the present invention can be realized by using a circuit, as a base, described in U.S. Pat. No. 5,262,881.

At first, description will be made as to an embodiment of the construction of a circuit generally usable. FIG. 11 is a block diagram of a circuit for effecting a display of 16 gray shades for R, G and B respectively. Signals of 16 gray shades are transformed into 4 bit signals from MSB to LSB, and the data signals are inputted to a data pretreatment circuit 1 which is to produce data signals with a format suitable for forming column signals and outputs the data signals to a column signal generating circuit 2 at a suitable timing. The column signal generating circuit 2 receives the data signals from the data pretreatment circuit 1 and orthogonal functional signals outputted from an orthogonal function generating circuit 5.

The column signal generating circuit 2 performs predetermined operations with use of the both signals to form column signals, and outputs the signals to a column driver 3. The column driver 3 produces column electrode voltages to be applied to the column electrodes of a liquid crystal panel 6 with use of a predetermined reference voltage, and outputs the column electrode voltages to the liquid crystal panel 6. On the other hand, the row electrodes of the liquid crystal panel 6 are applied with row electrode voltages which are obtained by converting the orthogonal function signals outputted from the orthogonal function generating circuit 5 in a low driver 4. These circuits may be provided with a timing circuit so that they are operated at predetermining timings.

The orthogonal function used in the present invention is produced by the orthogonal function generating circuit 5. The orthogonal function generating circuit 5 can perform operations every time when the orthogonal function signals are produced. However, it is preferable from the viewpoint of easiness that the orthogonal function signals to be used are previously reserved in a ROM, and the signals are read out at a suitable timing. Namely, pulses for controlling the timing of the application of voltages to the liquid crystal panel 6 are counted, and the orthogonal function signals in the ROM are successively read out by using the counted value as an addressing signals.

The data pretreatment circuit 1 is constituted as shown in FIG. 12. Signals are treated by dividing 4-bit picture data having a gray shade information into four groups each having 3 bits for R, G and B. Namely, the signals are divided into four groups of MSB($2^3$), 2nd MSB($2^2$), 3rd MSB($2^1$) and LSB($2^0$) in order to treat them in parallel.

The 3-bit data are inputted to 5-stage series/parallel converts 11 where the data are converted into 15-bit data, and the data are fed to memories 12. Specifically, serial data are inputted to the input terminals of 5-stage shift registers, and the tap output of the registers is inputted to each of the memories.

As the memories 12, VRAMs having a data width of 16 bits are used. Addressing operation to the memories 12 are conducted with use of direct access mode as follows. Namely, the data on the row electrodes corresponding to the same column electrodes are stored in adjacent 7 addresses with respect to 7 row electrodes which are simultaneously selected, whereby the reading-out operations from the memories at the late stage can be conducted at a high speed, and calculations can be easily.

The reading-out of the data from the memories is conducted at a timing of driving the LSB by a rapid successive access mode so that four sets of 15-bit data are fed to a data format conversion circuit 16. In a case of making the imaginary data in correspondence with the data on the row electrodes in the vicinity of the imaginary electrode, the reading-out of the data is repeated several times at the position corresponding to the imaginary row electrode.

The data format conversion circuit 16 is adapted to re-arrange the 15-bit data supplied for each gray shade in parallel into parallel signals having a 20-bits width for R, G, B. The circuit performing such function can be obtained by wiring suitably on a circuit substrate.

Data which have been converted into three sets of 20 bit data for R, G and B in the data format conversion circuit 16, are supplied to dray shade determination circuits 15. Each of the gray shade determination circuits 15 is a frame modulation circuit which converts dray shade data of 4-bits per dot into 1-bit data of ON/OFF to use them as video signals for a subpicture surface, and realizes a gray shade display for the subpicture surface in 15 cycles for instance.

Specifically, a multiplexer which distributes the data of a 20 bit length to date of a 5 bit length at a predetermined timing, is used. The relation of correspondence of bits to the subpicture surfaces is determined by a count number by a frame counter. Thus, the 20-bit data corresponding to the gray shade data for 5 dots are converted into serial data without gray shade of 5 bits to be outputted to vertical/lateral direction conversion circuits 13.

Each of the vertical/lateral conversion circuits 13 is a circuit for storing the display data for 5 pixels by the transferring 7 times, and for reading-out the display data as data for 7 pixels which are read out in 5 times. The vertical/lateral conversion circuit 13 is constituted by two sets of 5×7 bit registers. The data signals of the vertical/lateral conversion circuit 13 are transferred to the column signal generating circuits 2.

FIG. 13 shows the construction of the column signal generating circuit 2. 7 bit data signals are inputted to each exclusive OR gate 23. Each of the exclusive 0R gates 23 also receives signals from the orthogonal function generating circuit 5. Output signals from the exclusive OR gates 23 are supplied to an adder 21 in which a summing operation is conducted for the data on simultaneously selected row electrodes.

The column drivers have such a construction as shown in FIG. 14, wherein each comprises a shift register 21, a latch 32, a decoder 33 and a voltage divider 34. A demultiplexer is used for a voltage level selection device 33. When the data on a line is supplied to the shift register 21, the conversion of the display data into column voltages is performed.

The row driver 4 has a construction shown in FIG. 15. It comprises a driving pattern register 41, a selection signal register 42 and a decoder 43. Row electrodes to be simultaneously selected are determined depending on data of the selection signal register 42, and the polarity of the selection signals to be supplied to the selected row electrodes is determined depending on the data of the driving pattern register 41. A zero(0) volt is outputted to non-selection row electrodes.

FIG. 24 is an embodiment of a circuit usable when imaginary data are selected from ON or OFF so that the variation of the column voltages is small. A dummy electrode is included in a subgroup. The circuit is different from the circuit shown FIG. 9 in that column signals are operated and formed in column signal generating circuits 21 nd 22 respectively in cases that the dummy data are in an ON state and OFF state.

The data of the subgroup just before the dummy electrode are previously stored in a latch circuit 31. Data from the column signal generating circuits 21 and 22 and data from the latch circuit 31 are supplied to a selection circuit 32 which includes a differential circuit, a comparator and a selector. The selection circuit 32 takes the difference between the data from the column signal generating circuit 21 and the data from the latch circuit 31 and the difference between the data from the column signal generating circuit 22 and the data from the latch circuit 31, and compares the absolute value of theses differences by the comparator. The selector selects a smaller value. Thus, the selected value is supplied to the column driver 3. As described above, the imaginary data can be selected to have either ON or OFF so that the variation of the column voltages becomes small.

FIGS. 11 through 15 and FIG. 24 show as examples of circuit. It is therefore noted that another construction of circuit can be used.

BRIEF DESCRIPTION OF DRAWINGS

FIG. 4*a* through 4*c* are diagrams showing a method of the application of voltages in an MLS method;

FIGS. 5*a* through 5*c* are diagrams showing Hadamard's matrices;

FIG. 6 is a diagram showing an Hadamard's matrix;

FIG. 7 is a diagram as an example of a selection matrix used in the present invention;

FIGS. 8*a* through 8*c* are diagrams showing other examples of selection matrix used in the present invention;

FIG. 9 is a diagram showing another example of selection matrix used in the present invention;

FIG. 10 is a diagram showing another example of selection matrix used in the present invention;

FIGS. 18*a* through 18*c* are diagrams showing Hadamard's matrices;

FIG. 19 is a diagram showing an example of a selection matrix used in the present invention;

FIGS. 20*a* and 20*b* are diagrams showing other examples of a selection matrix used in the present invention;

FIG. 21 is a diagram showing an example of a selection matrix used in a comparative example;

FIG. 25*a* is a diagram showing an Hadamard's function, FIG. 25*b* is a diagram showing a column voltage in an entirely ON display,and FIG. 25*c* is a graph showing the variation of column voltage in an entirely ON display in the present invention;

FIG. 26*a* is a graph showing another orthogonal function, FIG. 26*b* is a graph showing the variation of a column voltage in an entirely ON display, and FIG. 26*c* is a graph showing the variation of a column voltage in an entirely ON display according to the present invention;

EXAMPLES

Examples 1 Through 5

Figure 1:
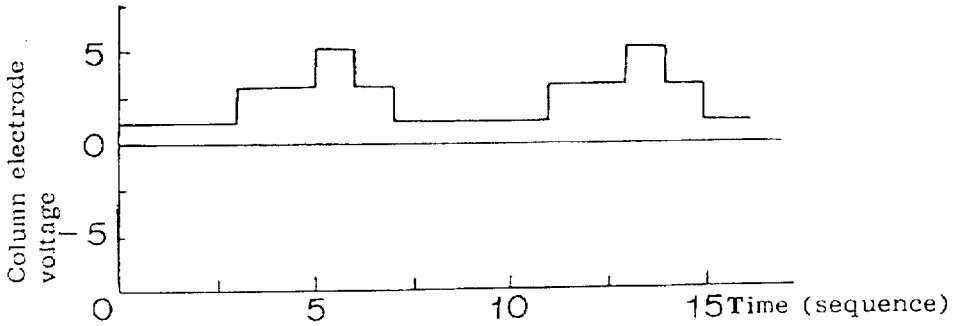
FIGS. 1*a* through 1*d* are waveform diagrams showing column voltage waveforms in an entirely ON display in the driving method of the present invention.
Figure 1:
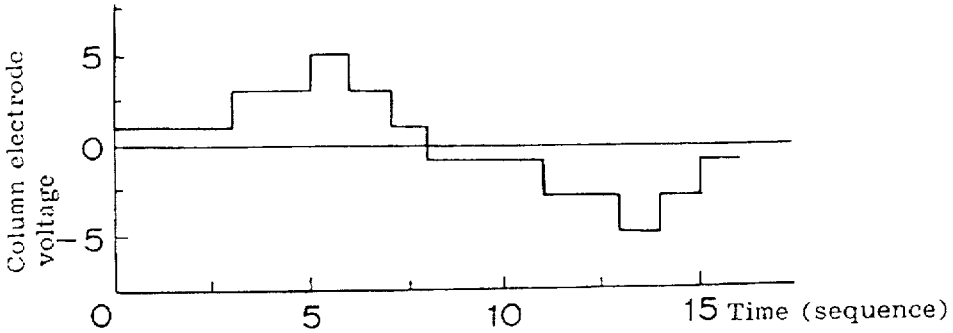
Figure 1:
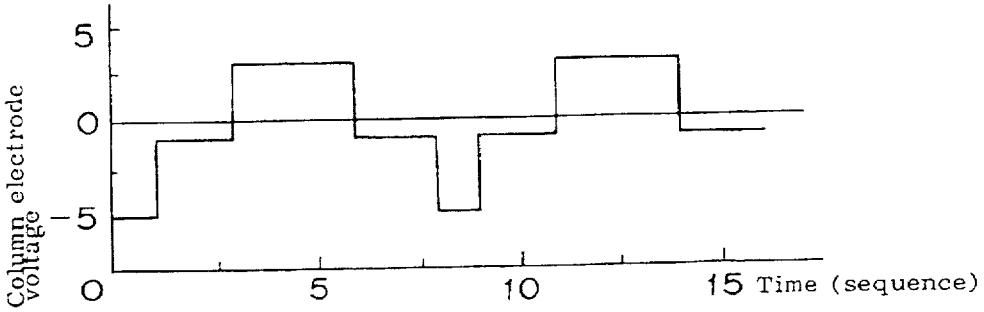
Figure 1:
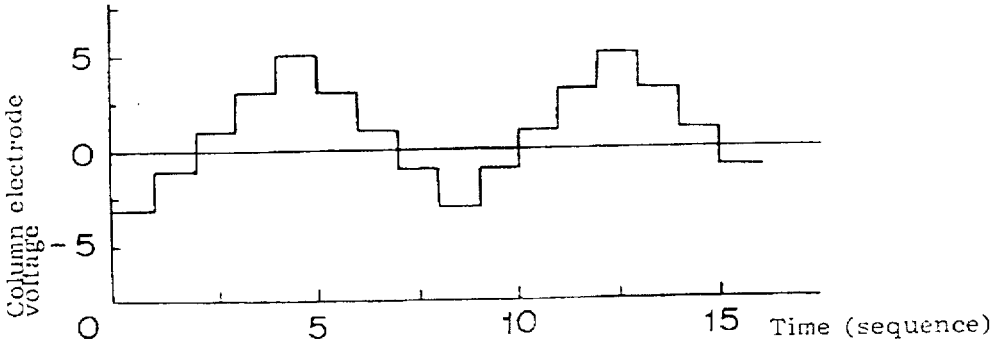

Each liquid crystal display panel 7 was driven under the following conditions with use of the circuit shown in FIGS. 11 through 15. The liquid crystal display panel had a VGA module of 9.4 inches (the number of pixels: 480×240×3

(RGB)) and a back light at the back surface. The response time of the liquid crystal display panel by taking the rising time and the falling time was 60 ms in average. The panel was driven by simultaneously selecting 7 row electrodes for each subgroups and advancing a column of the selection matrix by one (method 1). The picture surface was divided into two picture surfaces in the vertical direction. By dividing the picture surface into the two picture surfaces, the number of the subgroups was 35. The adjustment of the bias was conducted so that the contrast ratio became substantially the maximum. The contrast ratio of display was 30:1 and the maximum brightness was 100 cd/m$^2$.

Figure 3:
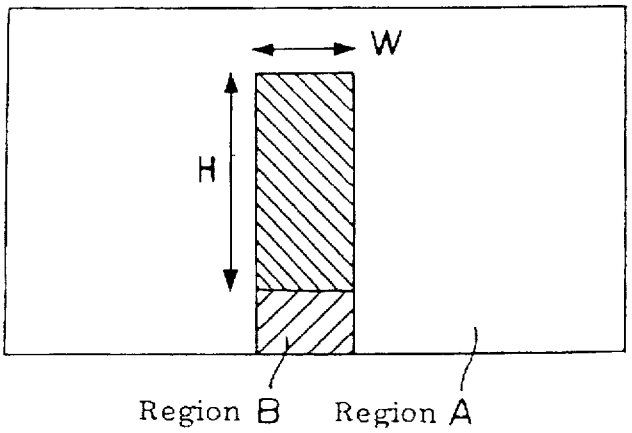
FIG. 3 is a diagram for illustrating a crosstalk.

The evaluation of the quality of crosstalks was made as follows. The voltage-brightness characteristics in the region B was measured in two cases that the pattern shown in FIG. 3 was formed in the upper picture surface, and such pattern was not formed. Two kinds of pattern: an entirely OFF pattern and an alternate white and black pattern were used. The definition of the crosstalk quantity is as follows.

$$|T_1-T_2|/T_1\times 100(\%)$$

where T1 represents the brightness without any pattern (entirely ON and T2 is the brightness in a case that there is a pattern in the background of entirely ON. The brightness was measured by applying a voltage by which the contrast ratio became the maximum.

Table 3 shows a result. In Examples 1 through 4, the crosstalk was remarkably decreased. Even in a picture display in a window, the crosstalk was in a negligible level.

TABLE 3

Figure 2:
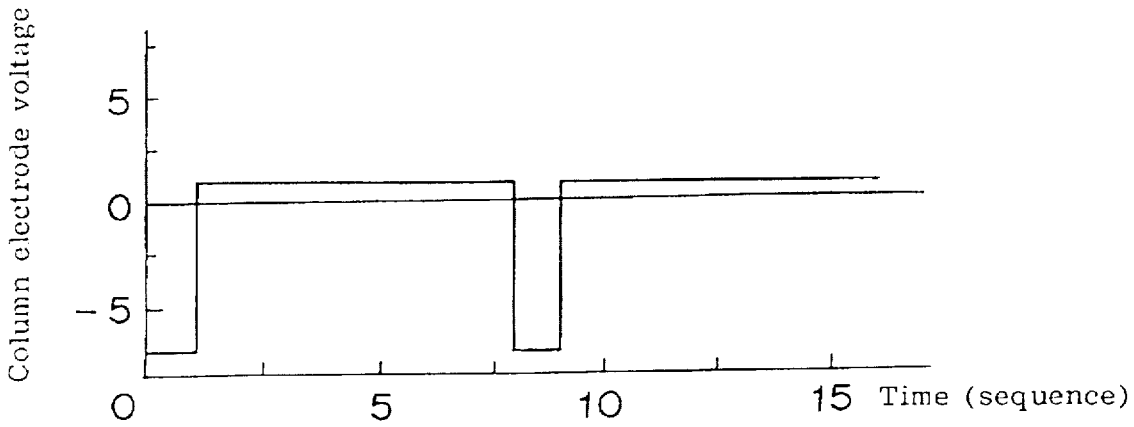
FIG. 2 is a waveform diagram showing a column voltage waveform in an entirely ON display in a conventional driving method.

| | | Crosstalk quantity | |
|---|---|---|---|
| | Waveform | Entirely OFF pattern | White and black pattern |
| Example 1 | FIG. 1(a) | 3% | 17% |
| Example 2 | FIG. 1(b) | 5% | 3% |
| Example 3 | FIG. 1(c) | 20% | 4% |
| Example 4 | FIG. 1(d) | 13% | 2% |
| Example 5 | FIG. 2 | 110% | 78% |

Example 6

The same liquid crystal display panel as in Example 1 was driven in the following conditions with use of the circuit shown in FIGS. 11 through 15. The liquid crystal display panel was driven by simultaneously selecting 7 row electrodes, selecting subgroups and advancing the columns of the selection matrix by one (the method 1). The picture surface was divided into two picture surfaces vertically. In the dual scan driving of the two picture surfaces, the number of the subgroups was 35. The adjustment of the bias was conducted so that the contrast ratio became substantially the maximum. For the gray shade, a spatial modulation frame control system was used. The contrast ratio of a display was 30:1 and the maximum brightness was 100 cd/m$^2$.

The matrix shown in FIG. 19 was used as the selection matrix. In this example, the crosstalk quantity was remarkably reduced. Even when a video display is displayed in a window on the picture surface, the crosstalk was in a negligible level.

Example 7

The same conditions as in Example 6 were used for display except that the matrix shown in FIG. 21 was used as the selection matrix. There was found little crosstalk in the usual window picture surface. However, in a dynamic display of video picture image, a crosstalk took place and the reduction of the quality of the display was remarkable.

In the use of the selection matrix, the maximum displacement was 2 for the reference pattern 1 and the maximum displacement was 8 for the reference pattern 2. The some of the values was 10 which did not satisfy both the conditions A and B.

Examples 8 And 9

Figure 22:
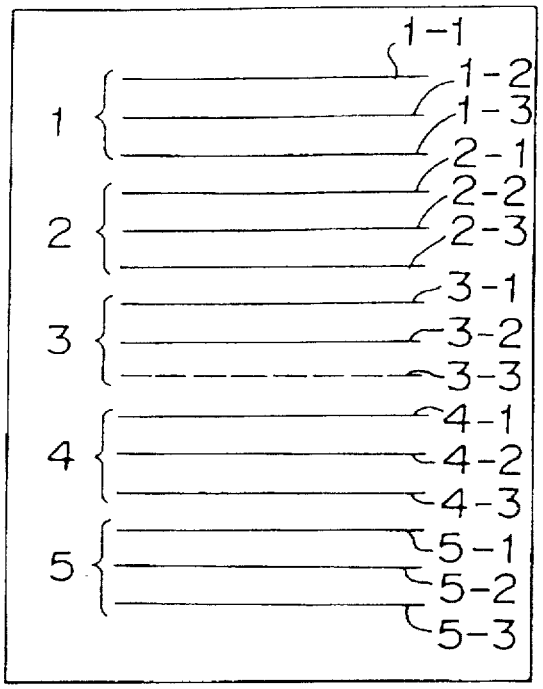
FIG. 22 is a diagram illustrating the arrangement of an imaginary row electrode on a picture surface.
Figure 23:
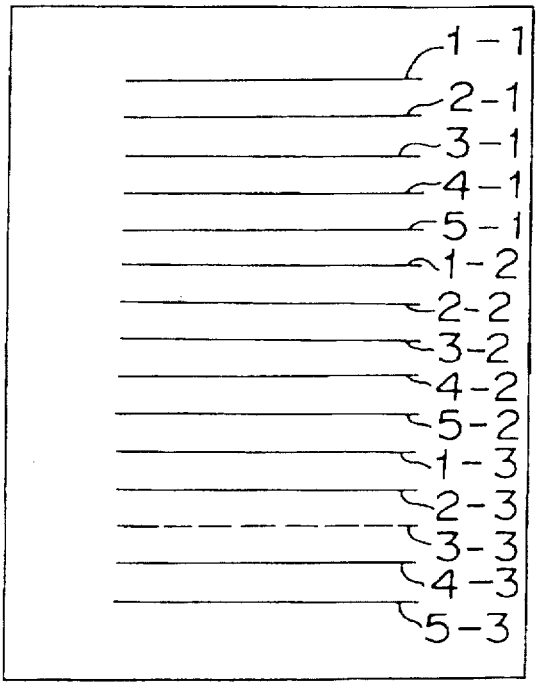
FIG. 23 is a diagram illustrating another embodiment of the arrangement of an imaginary row electrode on a picture surface.
Figure 24:
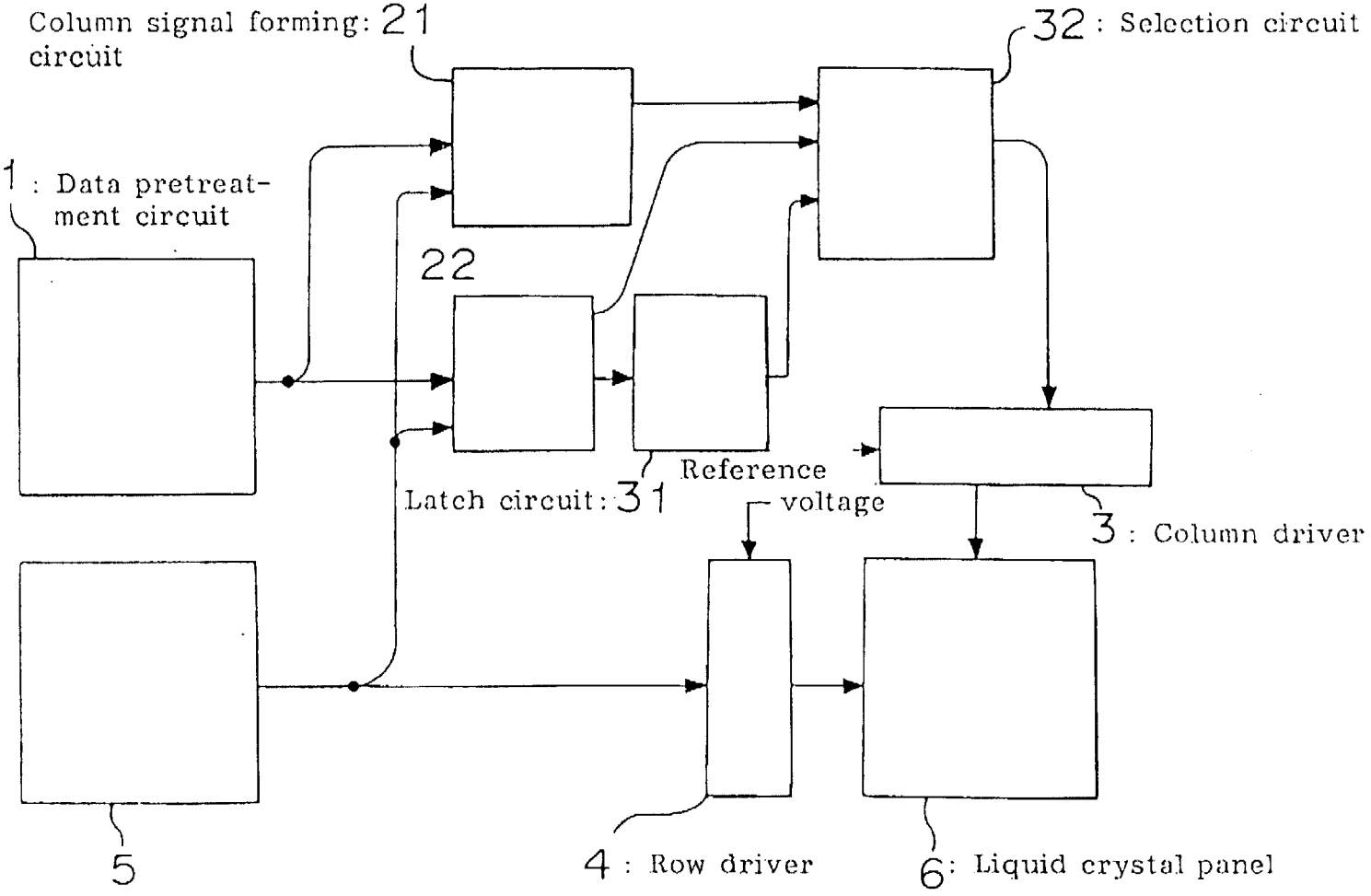
FIG. 24 is a block diagram showing an embodiment of the driving circuit for realizing the driving method of the present invention.

The same liquid crystal display panels as used in Example 1 were driven under the following conditions with use of the circuit shown in FIGS. 11 through 15. Each of the panels was driven by simultaneously selecting 7 row electrodes, selecting subgroups and advancing the columns of the selection matrix by one. The picture surface was divided into two picture surfaces vertically. In the dual scan driving, the number of the subgroup was 35. In the subgroups of the 31th through the 35th, the row electrodes were actual electrodes and an electrode (7th electrode) was an imaginary electrode. In the arrangement of the row electrode on the picture surfaces, the simultaneously selected row electrodes were arranged as a mass as shown in FIG. 22. The adjustment of the bias was conducted so that the contrast ratio became substantially the maximum. The contrast ratio of the display was 30:1 and the maximum brightness was 100 cd/m$^2$.

In Example 8, the circuit shown in FIG. 24 and FIGS. 12 through 15 was used, and the display data on the imaginary row electrode were formed by selecting ON or OFF so that the variation of the voltages on the column electrodes having such data was small. As a result, there was found no black stripe at the center of the picture surfaces and the picture surfaces having excellent quality could be obtained.

In Example 9, the circuit shown in FIGS. 11 through 15 was used and the display data on the imaginary electrode was made coincident with the display data on the 6th row electrode. As a result, black stripes at the central portion of the picture surfaces were not conspicuous and the picture surfaces having excellent quality could be obtained.

Examples 10 Through 12

The same liquid crystal display panels as in Examples was driven under the following conditions with use of the circuit shown in FIGS. 11 through 15. In each of the display panels, a 48 number of row electrodes were divided to form upper and lower picture surfaces each having 240 row electrodes, and two picture surfaces were driven. The display panels were driven as follows. 7 row electrodes were simultaneously selected. The simultaneously selected row electrodes were arranged as a mass and adjacent to each other in the picture surfaces. The column vectors of the selection matrix were advanced by one in the selection of each subgroup (method 1). In the dual scan driving (which was divided in the vertical direction), the number of subgroups was 35 in which 5 electrodes were dealt as imaginary electrodes. The adjustment of the bias was conducted so that the contrast ratio became substantially the maximum. The contrast ratio of the display was 30:1 and the maximum brightness was 100 cd/m$^2$.

Figure 27:
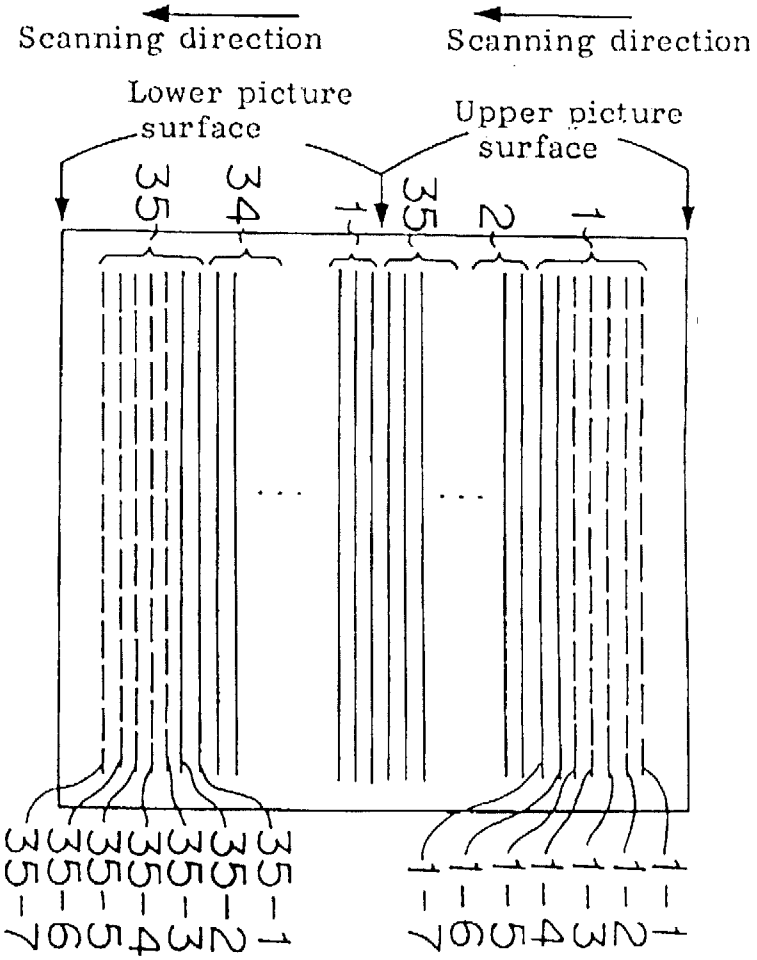
FIGS. 27*a* and 27*b* are diagrams illustrating the arrangement and the sequence of imaginary row electrodes on a picture surface.
Figure 27:
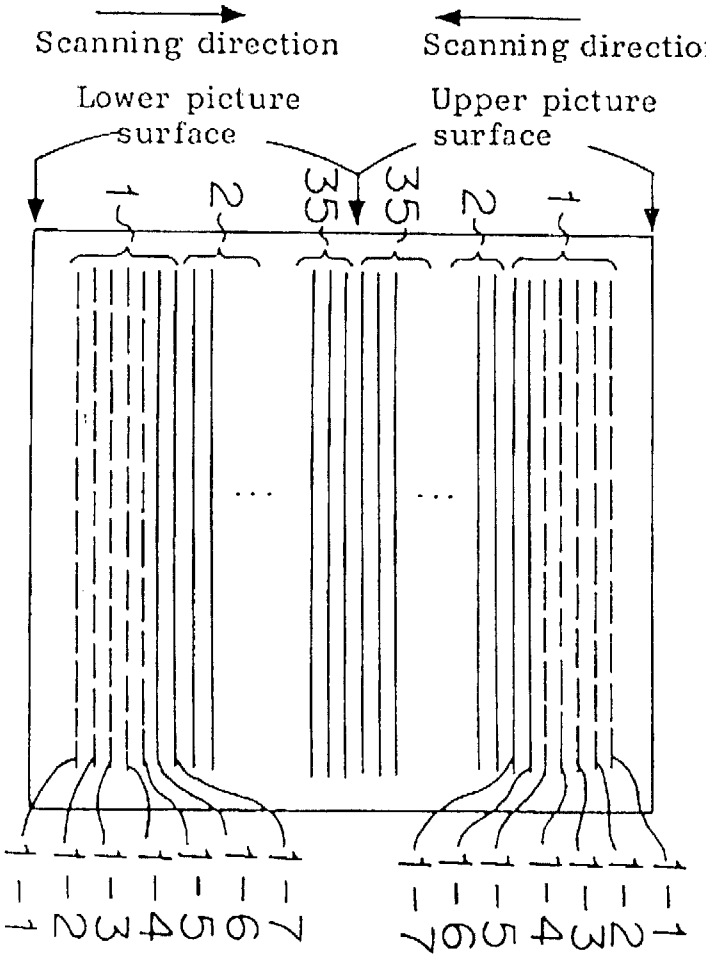

In Example 10, the liquid crystal panel with the arrangement of the imaginary row electrodes was driven by the sequence as shown in FIG. 27*a*. Namely, row electrodes 1-1 to 1-5 in a row electrode subgroup 1 were, supposed to be imaginary row electrodes in the upper picture surface, and row electrode 35-3 to 35-7 in a row electrode subgroup 35 were supposed to be imaginary electrodes in the lower picture surface. Scanning was conducted from the row electrode subgroup having a smaller number to that having a larger number. In Example 12, the liquid crystal display panel with the arrangement of imaginary row electrodes was driven by the sequence as shown in FIG. 27*b*. In both the upper and lower picture surfaces, row electrodes 1-1 to 1-5 in a row electrode subgroup 1 were supposed to be imaginary electrodes. Scanning was conducted from the row electrode subgroup having a smaller number to that having a larger number.

Figure 28:
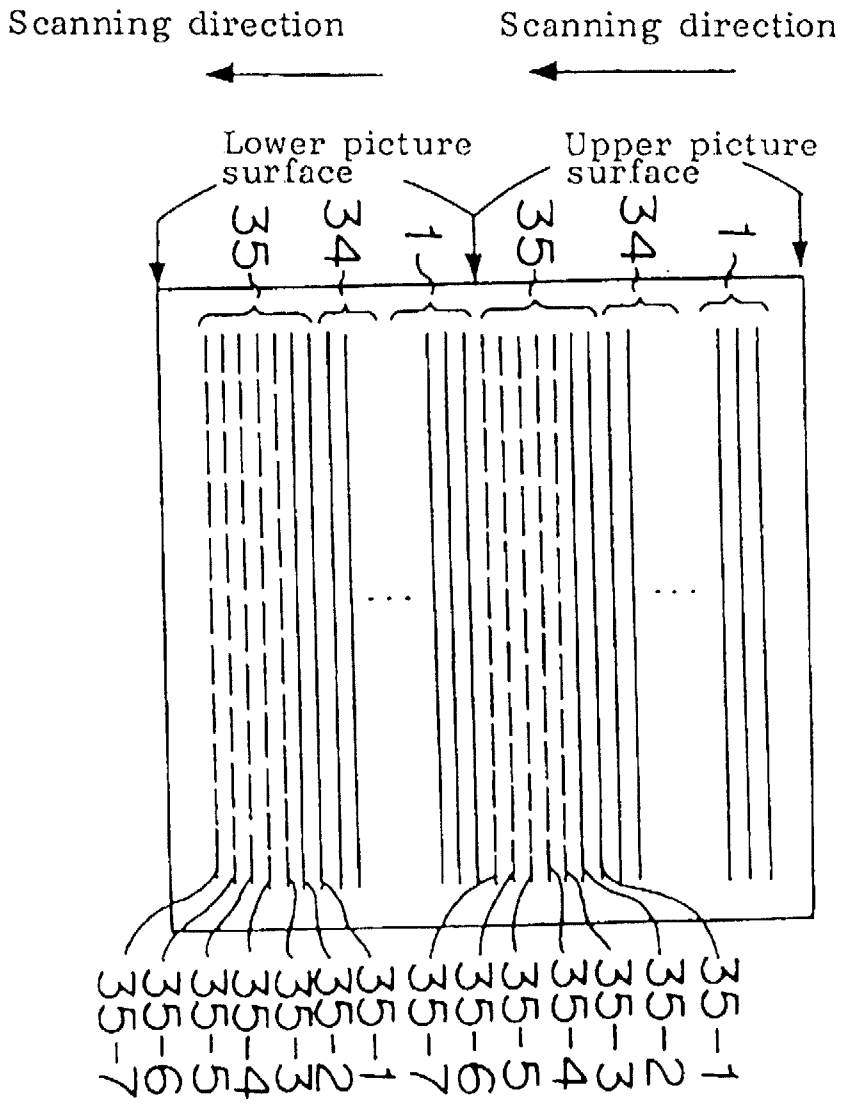
FIG. 28 is a diagram showing the arrangement and the sequence of imaginary row electrodes on a picture surface in a comparative reference.

In Example 12, the liquid crystal display panel with the arrangement of the imaginary row electrodes was driven by the sequence as shown in FIG. 28. In both the upper and the lower surfaces, row electrodes 35-3 to 35-7 of a row electrode subgroup 35 were supposed to be imaginary electrodes. Scanning was conducted from the row electrode subgroup having a smaller number to that having a larger number.

As a result, Example 11 showed the smallest unevenness of display at a position near the boundary between the upper and the lower picture surfaces, Example 10 came to the next, and Example 12 showed the largest unevenness of display.

Example 13

Figure 11:
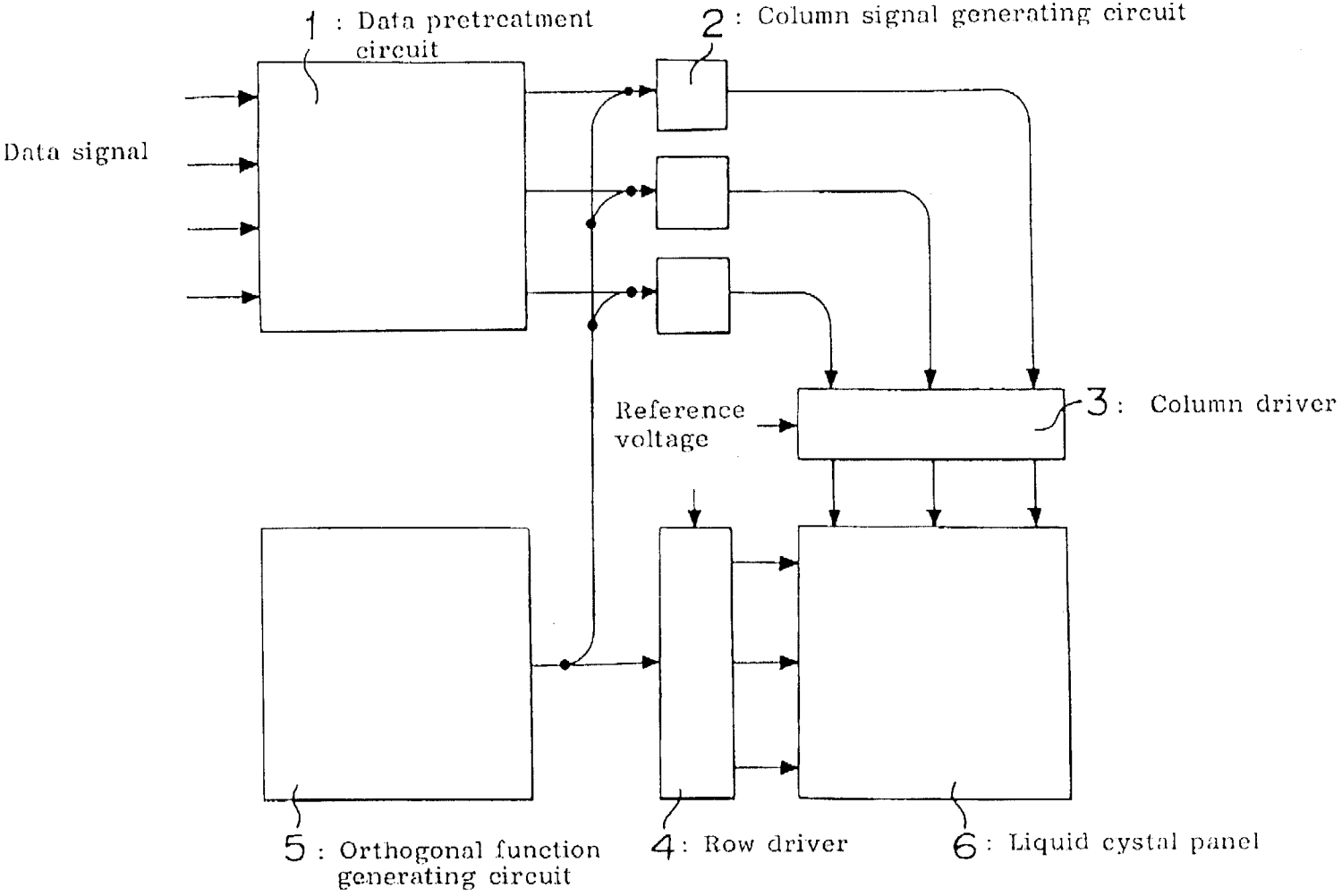
FIG. 11 is a block diagram showing an embodiment of the construction of a circuit for practicing the present invention.
Figure 12:
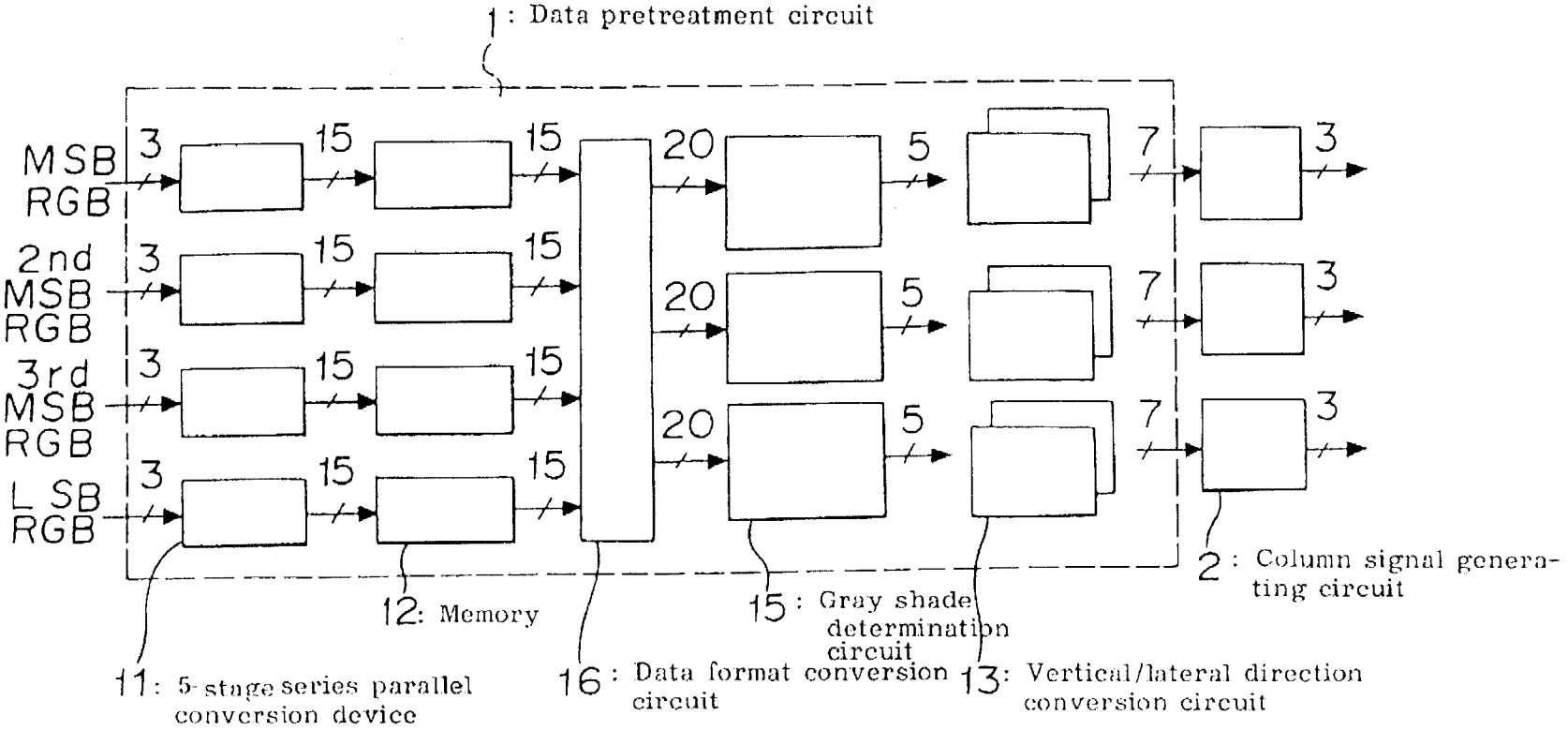
FIG. 12 is a block diagram showing a data pretreatment circuit 1.
Figure 13:
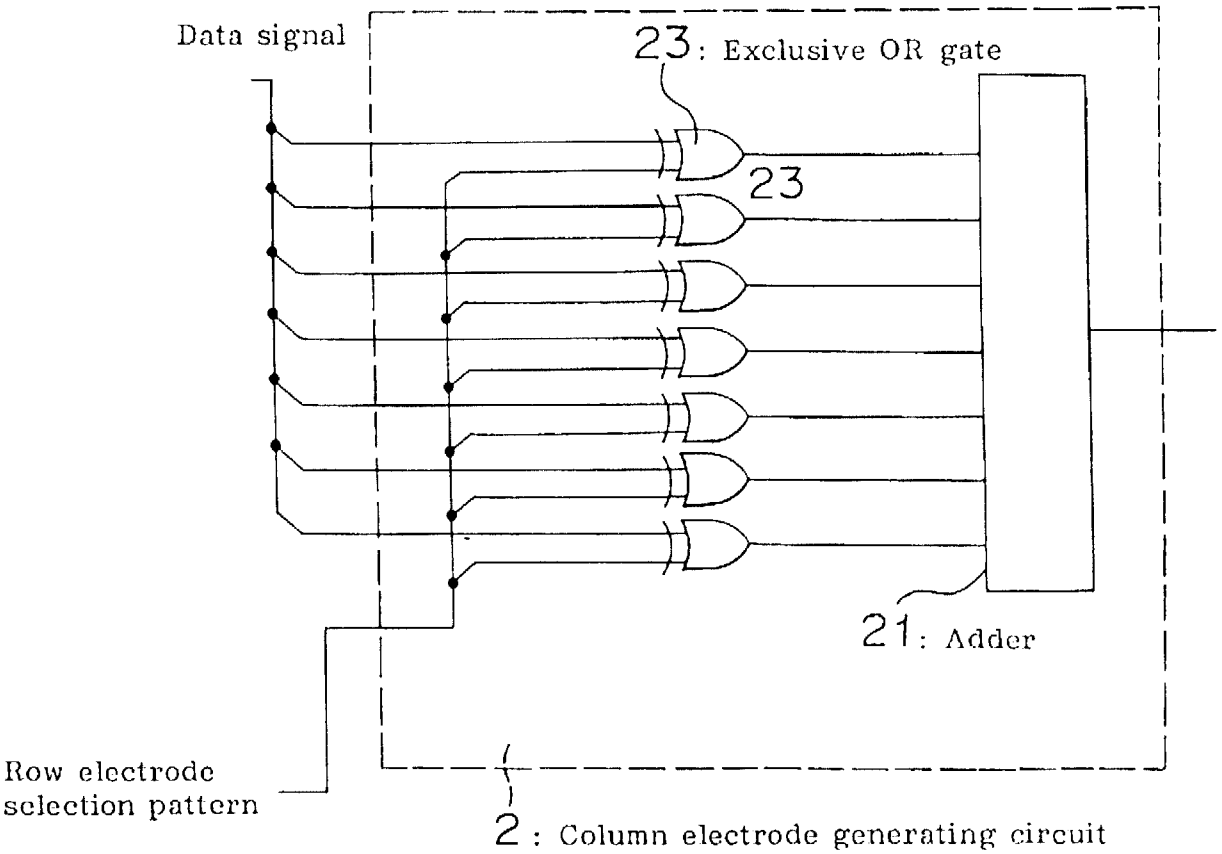
FIG. 13 is a block diagram showing a column signal generating circuit 2.
Figure 14:
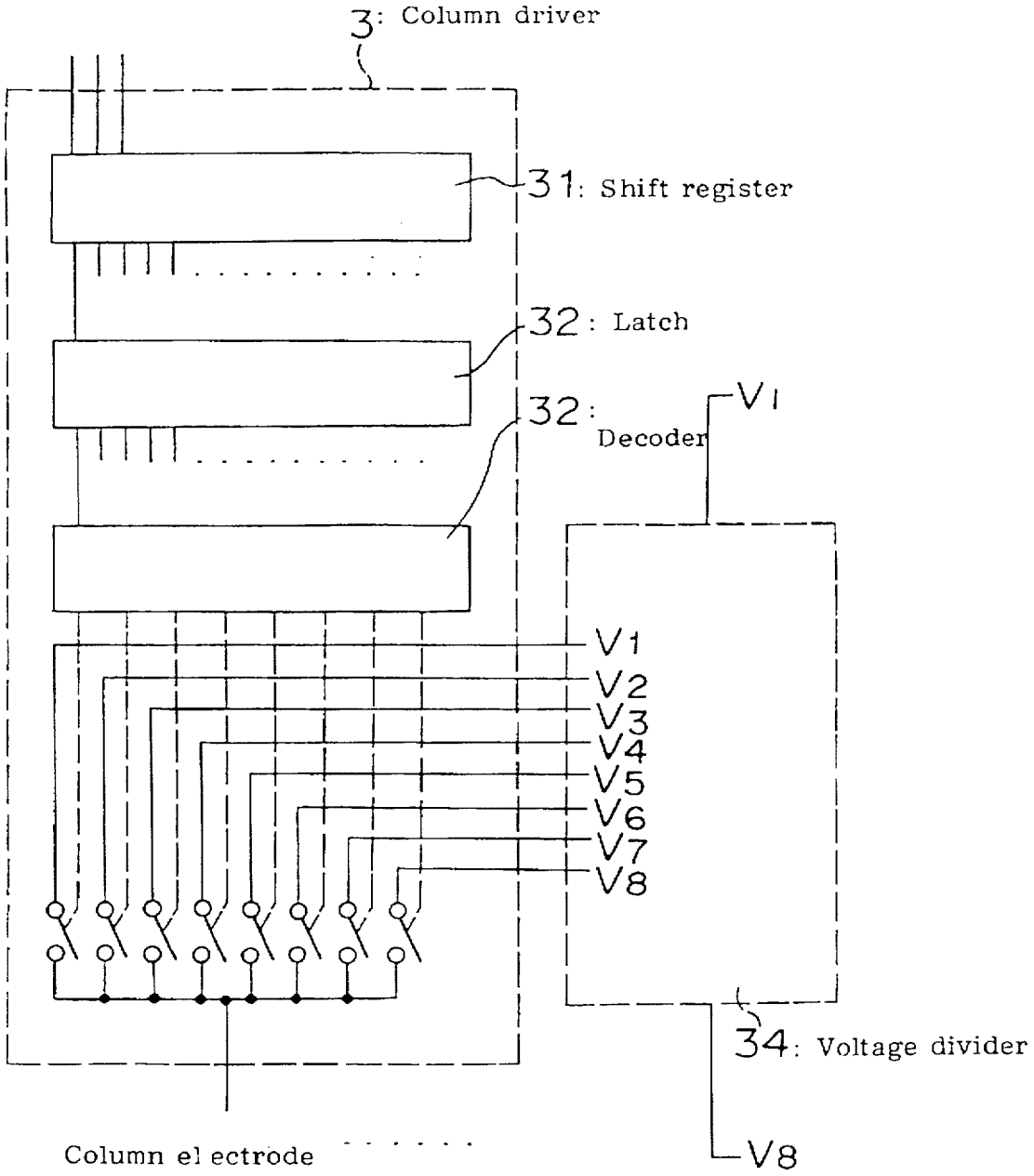
FIG. 14 is a block diagram showing a column driver 3.
Figure 15:
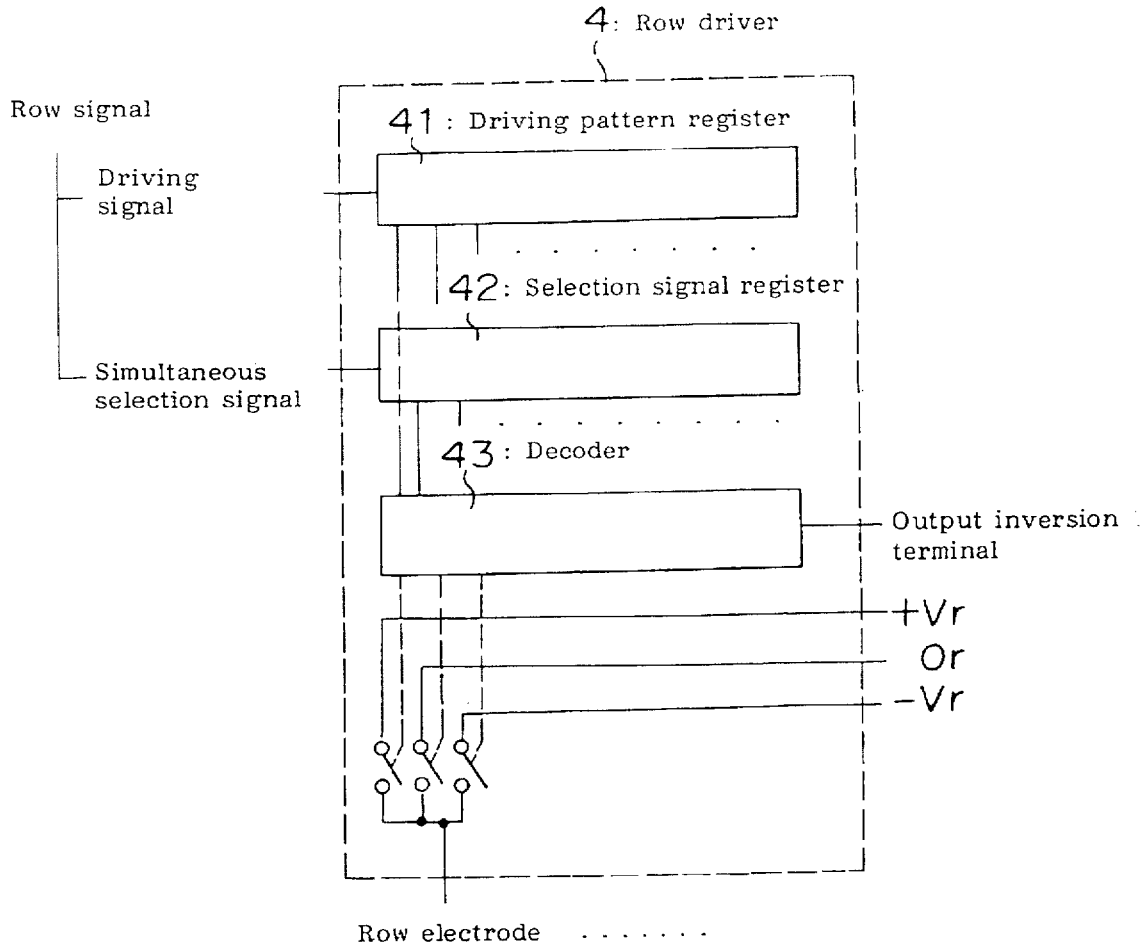
FIG. 15 is a block diagram showing a row driver 4.
Figure 16:
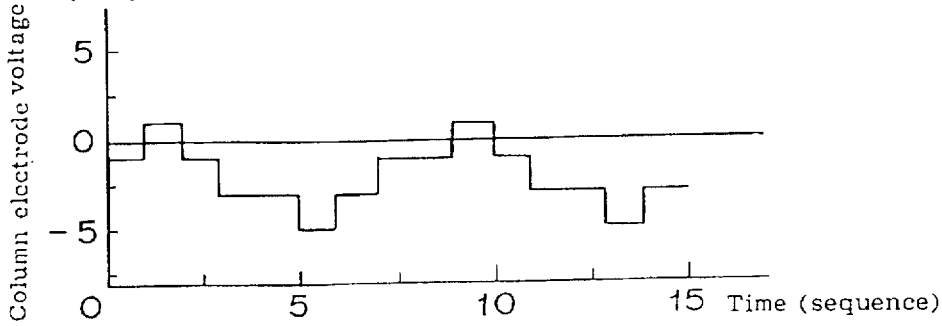
FIGS. 16*a* and 16*b* are waveform diagrams showing column voltage waveforms in an entirely ON display and an ON/OFF display in the driving method of the present invention.
Figure 16:
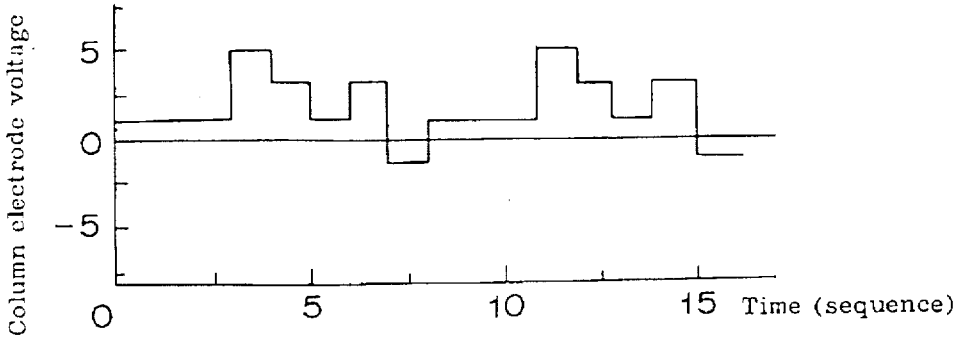
Figure 17:
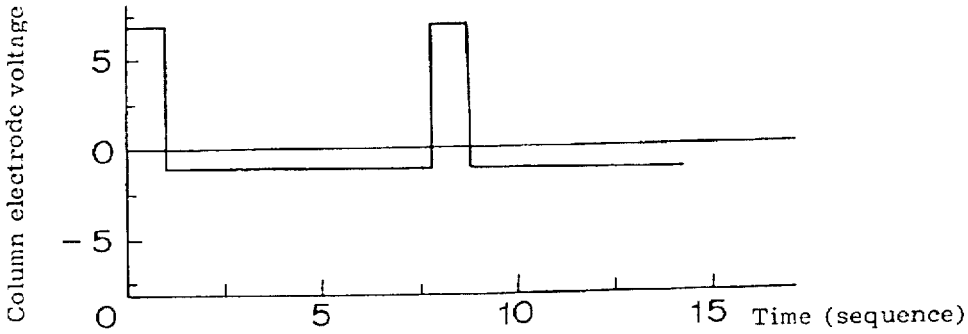
FIGS. 17*a* and 17*b* are waveform diagrams showing column voltage waveforms in an entirely ON display and an ON/OFF display in the conventional driving method.
Figure 17:
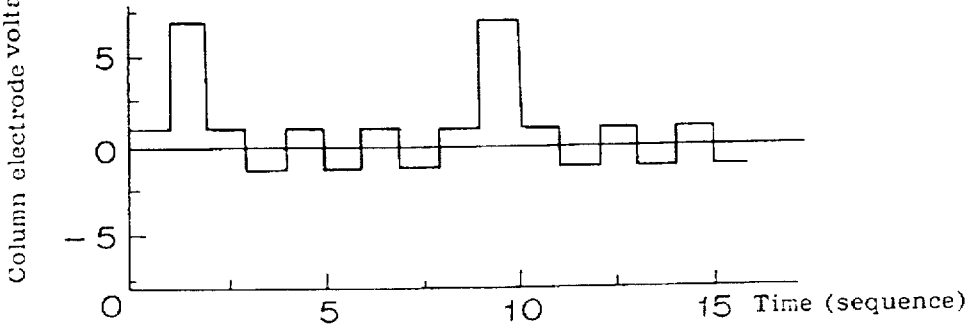

The liquid crystal display panel 7 was driven in the following conditions with use of the circuit shown in FIG. 11. The liquid crystal display panel had a VGA module of 9.4 inches (the number of pixels: 480×640×3 (RGB)) and a back light at the back surface. The response time of the liquid crystal display panel by taking the rising time and the falling time was 60 ms. The panel was driven by simultaneously selecting 4 row electrodes for each subgroup and advancing a column of the selection matrix by one (method 1). The picture surface was divided into two picture surfaces in the vertical direction. In the dual scan driving of the picture surfaces, the number of the subgroups was 60. The adjustment of the bias was conducted so that the contrast ratio became substantially the maximum. For the gray shade, a spatial modulation frame ratio control was used.

The contrast ratio of display was 40:1, and the maximum brightness was 100 cd/m$^2$.

The matrix shown in FIG. 7 was used as the selection matrix. The number of row lines was 244 by adding four imaginary lines to 240 lines so that the number of subgroups to be driven was 61.

The vector sequence was formed as shown in the Table (1 frame) described below wherein subgroups to be selected are made in correspondence to selection column vectors.

subgroup in the upper picture surface, and the data on the 60th subgroup in the upper picture surface was used for the 61th subgroup in the lower picture surface. This is because the continuity of the column waveform can be kept so as not to cause an uneven display at or around the central portion (the boundary portion between the upper and lower picture surfaces). As a result, a uniform display could be obtained wherein there is substantially no unevenness on the crosstalk.

In accordance with the present invention, when a column electrode voltage sequence satisfies specified conditions on $\Delta y_i$ in a multiple line simultaneous selection driving method, the variation of column voltages can be substantially suppressed and a crosstalk caused by the distortion of waveform can be remarkably suppressed. In this case, by inverting row signals and column signals before the completion of a display cycle, it is easy to remove a direct current component to be applied to liquid crystal. Further, a frequency region which includes the center of the driving waveform can be controlled, and an unevenness of display or a flicker which is caused due to an excessive low frequency component can be suppressed.

Further, the variation of the effective value which is caused by the distortion of waveform due to the polarity inversion of signals can be controlled by satisfying the conditions of $|Y_{j-1}| \leqq 0.5 \cdot L$ and $|Y_j| \leqq 0.5 \cdot L$ (j−1 and j are affix letters indicating just before and just after the polarity inversion). Accordingly, the crosstalk can effectively be controlled. In particular, when both the above-mentioned conditions and the condition concerning $\Delta y_i$ are satisfied, a crosstalk level can be further lower than the crosstalk level obtained by the conventional successive line driving method.

In the above-mentioned case, when the polarity inversion is conducted every time of steps multiplied by k where a step indicates the application of a row electrode selection pulse and K indicates the number of selection pulses in a display cycle on a specified row electrode, the polarity inversion is effected at a timing that the number of times of the polarity inversion can be reduced whereby the crosstalk can effectively be controlled.

Further, in a case of a column electrode voltage sequence $(y_1, y_2, \ldots, y_N)$ to $(x)=(1, 1, \ldots, 1)$, wherein K represents the number of selection pulses in a display cycle on a specified row electrode, a step indicates the application of a row electrode selection pulse, and a time period from the time point changing from negative to positive to the next time point changing from negative to positive substantially corresponds to K steps, a direct current component left in a display cycle becomes small, and an unevenness of display

| | 1 | 2 | 3 | 4 | 5 | 6 | 7 | 60 | 61 | 62 | 121 | 122 | | 243 | 244 |
|---|---|---|---|---|---|---|---|---|---|---|---|---|---|---|---|
| subgroups | 1 | 2 | 3 | 4 | 5 | 6 | 7 | 60 | 61 | 1 2 3 4 | 60 | 61 | 1 2 | . . . 60 | 61 |
| column vectors | 1 | 2 | 3 | 4 | 1 | 2 | 3 | 4 | 1 | 2 3 4 1 | 1 | 2 | 3 4 | 3 | 4 |

The polarity inversion was effected every S=23 pulses.

In this example, a uniform display could be obtained and the crosstalk quantity was remarkably reduced. Even when a video display is displayed in a window on the picture surface, the crosstalk was in a negligible level.

The imaginary lines were arranged at the last in the picture surface (the 61th subgroup) in either upper picture surface or the lower picture surface. The data on the first subgroup of the lower picture surface was used for the 61th due to a row frequency component which is caused by an unevenness of Vth of liquid crystal can be controlled. In this case, in particular, when the direct current component in a display cycle can be completely removed, the unevenness of display due to the row frequency component and the interference of a plurality of frequency components can effectively be controlled.

Further, when the frequency of row electrode voltage sequence vectors for each row electrode is made substantially equal in simultaneously selected row electrodes, the unevenness of display in the row electrodes can be suppressed.

Further, when the relation of M and N in a row electrode pulse sequence matrix S is $N \leqq 4M$, an uneven display due to a row frequency component can be stable.

We claim:

1. A method of driving a picture display device having a plurality (an M number) of row electrodes and a plurality of column electrodes, by selecting an L number ($L \geqq 3$) of row electrodes simultaneously and by applying to the row electrodes voltages based on signals obtained by developing in time sequence column vectors of an M row–N column orthogonal matrix S (having elements 1, −1 and 0), the driving method being characterized in that:

column electrode display pattern vectors ($x=x_1, x_2, \ldots x_M$) which have as elements display patterns (1: OFF, −1: ON), corresponding to simultaneously selected row electrodes, on a specified column electrode, and column electrode voltage sequence vectors ($y=(y_1, y_2, \ldots y_N)$) which have as elements voltage levels, on the column electrode which consists of an N number of voltage pulses arranged in time sequence in a display cycle, have a relation of $(y_1, y_2, \ldots y_N)=(x_1, x_2, \ldots x_M)$ (S), wherein when $\Delta y_i=|y_1, -y_{i-}|(i=2-N)$, the sum Q of the maximum value $\Delta y_{MAX1}$ of $\Delta y_1$ to $(x)=(1, 1, \ldots 1)$ and the maximum value $\Delta y_{MAX2}$ of $\Delta y_1$ to $(1, -1, 1, -1, \ldots)$ substantially satisfies $Q<1.4 \cdot L$.

2. The method of driving a picture display device according to claim 1, wherein the polarities of row signals and column signals are inverted before the completion of a display cycle.

3. The method of driving a picture display device according to claim 2, wherein when an L number of row electrodes are simultaneously selected, column electrode voltages $Y_{j-1}$ and $Y_j$, before and after the polarity inversion, to $(x)=(1, 1, \ldots, 1)$ and $(x)=(1, -1, 1, -1 \ldots)$ respectively assume $|y_{j-1}| \leqq 0.5 \cdot L$ and $|y_j| \leqq 0.5 \cdot L$ (j−1 and j are affix letters indicating before after the polarity inversion).

4. The method of driving a picture display device according to claim 1, wherein when $(x)=(1, 1, 1, 1, \ldots 1)$, the polarities of the column electrode voltage sequence vectors are inverted just after each step in which the values |y| are equal, and the polarity inversion is effected periodically wherein the step corresponds to the application of each row electrode selection pulse.

5. The method of driving a picture display device according to claim 1, wherein in the column electrode voltage sequence vectors $(y_1, y_2, \ldots y_N)$ to $(x)=(1, 1, \ldots, 1)$ and $(x)=(1, -1, 1, -1, \ldots)$, the interval between a point changing from a negative value to a positive value and a point changing from the next negative value to the next positive value substantially corresponds to K steps where K represents the number of selection pulses in a display cycle for a specified row electrode and a step corresponds to the application of each row electrode selection pulse.

6. The method of driving a picture display device according to claim 1, wherein the frequency of the column electrode voltage sequence vectors for each row electrode is substantially the same in the simultaneously selected row electrodes.

7. The method of driving a picture display device according to claim 1, wherein M and N in the M row–N column orthogonal matrix S have a relation of $N \leqq 4M$.

8. The method of driving a picture display device according to claim 1, wherein a spatial modulation frame control method and/or a dithering method is used as a gray shade display method.

9. The method of driving a picture display device according to claim 1, wherein a video display is produced at least a part of the picture surface of the picture display device.

10. The method of driving a picture display device according to claim 1, wherein an imaginary row electrode is contained in at least a part of row electrodes, and data on the imaginary electrode are treated as changeable data which are changed depending on column electrode signals.

11. The method of driving a picture display device according to claim 10, wherein the changeable data are so selected from ON or OFF data that a change of voltage on column electrodes having the data at the ON or OFF time is small.

12. The method of driving a picture display device according to claim 10, wherein the changeable data are in agreement with data on a row electrode near the imaginary electrode.

13. The method of driving a picture display device according to claim 1, wherein the picture surface is divided into two picture surfaces to be independently driven; an imaginary electrode is contained in at least a part of groups of simultaneously selected row electrodes, and a group containing the imaginary electrode is disposed in an end portion of the picture surface.

14. The method of driving a picture display device according to claim 1, wherein the picture surface is divided into two picture surfaces to be independently driven; an imaginary row electrode is contained in at least a part of groups of the simultaneously selected row electrodes, and a group containing the imaginary electrode is disposed in an end portion of the picture surface.

15. A method of driving a picture display device having a plurality (an M number) of row electrodes and a plurality of column electrodes, by selecting an L number ($L \geqq 3$) of row electrodes simultaneously and by applying to the row electrodes voltages based on signals obtained by developing in time sequence column vectors of an M–row N column orthogonal matrix S (having elements 1, −1 and 0), the driving method being characterized in that:

the polarities of row signals and column signals are inverted before the completion of a display cycle;

column electrode display pattern vectors $(x)=(x_1, x_2, \ldots x_M)$ which have as elements display patterns (1: OFF, −1: ON), corresponding to simultaneously selected row electrodes, on a specified column electrode, and column electrode voltage sequence vectors $(y)=(y_1, y_2, \ldots y_N)$ which have as elements voltage levels, on the column electrode which consists of an N number of voltage pluses arranged in time sequence in the display cycle, have a relation of $(y_1, y_2, \ldots y_N)=(x_1, x_2, \ldots x_M)$ (S), and when an L number of row electrodes are simultaneously selected, column electrode voltages $y_{j-1}$ and $y_j$, before and after the polarity inversion, to $(x)=(1, 1, \ldots 1)$ and $(x)=(1, -1, 1, -1 \ldots)$ respectively assume $|y_{j-1}| \leqq 0.5 \cdot L$ and $|y_j| \leqq 0.5 \cdot L$ (j−1 and j are affix letters indicating before and after the polarity inversion).

16. A method of driving a picture display device having a plurality (an M number) of row electrodes and a plurality of column electrodes, by selecting an L number ($L \geqq 5$) of row electrodes simultaneously and by applying to the row electrodes voltages based on signals obtained by developing in time sequence column vectors of an M row –N column orthogonal matrix S (having elements 1, −1 and 0), the driving method being characterized in that:

column electrode display pattern vectors $(x=x_1, x_2, \ldots x_M)$ which have as elements display patterns (1: OFF, −1: ON), corresponding to simultaneously selected row electrodes, on a specified column electrode, and column electrode voltage sequence vectors $(y)=(y_1, y_2, \ldots y_N)$ which have as elements voltage levels, on the column electrode which consists of an N number of voltage pulses arranged in time sequence in and display cycle, have a relation of $(y_1, y_2, y_N)=(x_1, x_2, \ldots x_M)$ (S), wherein when $\Delta y_1 |y_1, -y_{i-1}|(i=2-N)$, $\Delta y_1<0.7\cdot L$ to $(x)=(1, 1, \ldots, 1)$.

17. The method of driving a picture display device according to claim 16, wherein the polarities of row signals and column signals are inverted before the completion of the display cycle.

18. The method of driving a picture display device according to claim 17, wherein when an L number of row electrodes are simultaneously selected, column electrode voltages $Y_{j-1}$ and $Y_j$, before and after the polarity inversion, to $(x)=(1, 1, \ldots, 1)$ respectively assume $|y_{j-1}|\leqq 0.5\cdot L$ and $|y_j|\leqq 0.5\cdot L$ (j−1 and J are affix letters indicating before and after the polarity inversion).

19. A method of driving a picture display device having a plurality (an M number) of row electrodes and a plurality of column electrodes, by selecting an L number (L>3) of row electrodes simultaneously and by applying to the row electrodes voltages based on signals obtained by developing in time sequence column vectors of an M row–N column orthogonal matrix S (having elements 1, −1 and 0), the driving method being characterized in that:

the polarities of row signals and column signals are inverted before the completion of a display cycle;

column electrode display pattern vectors $(x)=(x_1, x_2, \ldots x_M)$ which have as elements display patterns (1: OFF, −1: ON), corresponding to simultaneously selected row electrodes, on a specified column electrode, and column electrode voltage sequence vectors $(y)=(y_1, y_2, \ldots y_N)$ which have as elements voltage levels, on the column electrode which consists of an N number of voltage pulses arranged in time sequence in a display cycle, have a relation of $(y_1, y_2, y_N)=(x_1, x_2, \ldots x_M)$ (S), and when an L number of row electrodes are simultaneously selected, column electrode voltages $Y_{j-1}$ and $Y_j$, before and after the polarity inversion, to $(x)=(1, 1, \ldots, 1)$ respectively assume $|y_{j-1}|\leqq 0.5\cdot L$ and $|y_j|\leqq 0.5\cdot L$ (j−1 and j are affix letters indicating before and after the polarity inversion).

20. A method of driving a liquid crystal display device by selecting four row electrodes simultaneously, the method being characterized in that a series of pulses to be applied to simultaneously selected each row electrode has two kinds of voltage pulse polarities and the selection matrix being expressed by:

$$\begin{bmatrix} -1 & 1 & 1 & 1 \\ 1 & -1 & 1 & 1 \\ 1 & 1 & -1 & 1 \\ 1 & 1 & 1 & -1 \end{bmatrix} = A0$$

or the matrix obtained by replacing the row vectors of the matrix (A0), wherein one of the voltage pulse polarities is 1 and the other is −1.

21. A method of driving a liquid crystal display device by selecting seven row electrodes simultaneously, the method being characterized in that a series of pulses to be applied to simultaneously selected each row electrode has two kinds of voltage pulse polarities and the selection matrix being expressed by:

$$\begin{pmatrix} -1 & -1 & -1 & -1 & -1 & 1 & -1 & -1 \\ 1 & -1 & 1 & -1 & -1 & -1 & 1 & -1 \\ -1 & 1 & -1 & -1 & -1 & -1 & 1 & 1 \\ 1 & -1 & -1 & -1 & 1 & -1 & -1 & 1 \\ -1 & 1 & 1 & -1 & 1 & -1 & -1 & -1 \\ -1 & -1 & 1 & 1 & -1 & -1 & -1 & 1 \\ 1 & 1 & -1 & 1 & -1 & -1 & -1 & -1 \end{pmatrix} = [A1]$$

or the matrix obtained by replacing the row vectors and/or polarity reversing the column vectors of the matrix (A1).

* * * * *